US006061042A

United States Patent [19]

Takahashi et al.

[11] Patent Number: 6,061,042

[45] Date of Patent: May 9, 2000

[54] LIQUID CRYSTAL DISPLAY DEVICE

[75] Inventors: Hiroyuki Takahashi, Yokohama; Kenji Kameyama; Yasuyuki Takiguchi, both of Sagamihara; Akihiko Kanemoto, Yokohama; Fuminao Matsumoto, Tokyo-to; Kazuya Miyagaki, Yokohama, all of Japan

[73] Assignee: Ricoh Company, Ltd., Tokyo, Japan

[21] Appl. No.: 09/018,427

[22] Filed: Feb. 6, 1998

[30] Foreign Application Priority Data

| | | | |
|---|---|---|---|
| Feb. 6, 1997 | [JP] | Japan | 9-038373 |
| Sep. 19, 1997 | [JP] | Japan | 9-273548 |
| Dec. 9, 1997 | [JP] | Japan | 9-356122 |

[51] Int. Cl.[7] ..... G09G 3/36

[52] U.S. Cl. ..... 345/87; 349/130; 349/177

[58] Field of Search ..... 345/87, 94, 95, 345/97; 349/116, 124, 128, 33, 34, 179, 96, 130, 149, 177

[56] References Cited

U.S. PATENT DOCUMENTS

| | | | |
|---|---|---|---|
| 4,239,345 | 12/1980 | Berreman et al. . | |
| 5,488,499 | 1/1996 | Tanaka et al. . | |
| 5,543,950 | 8/1996 | Lavrentovich et al. | 359/77 |
| 5,560,554 | 10/1996 | Miyawaki et al. . | |
| 5,684,503 | 11/1997 | Nomura et al. | 345/97 |
| 5,835,075 | 11/1998 | Nomura et al. | 345/97 |
| 5,900,852 | 5/1999 | Tanaka et al. | 345/87 |

FOREIGN PATENT DOCUMENTS

| | | |
|---|---|---|
| 6-222332 | 8/1994 | Japan . |
| 6-222333 | 8/1994 | Japan . |
| 6-230751 | 8/1994 | Japan . |
| 6-235920 | 8/1994 | Japan . |
| 7-128642 | 5/1995 | Japan . |
| 7-128643 | 5/1995 | Japan . |
| 7-140444 | 6/1995 | Japan . |
| 7-218933 | 8/1995 | Japan . |
| 7-248485 | 9/1995 | Japan . |
| 7-294933 | 11/1995 | Japan . |
| 8-062639 | 3/1996 | Japan . |
| 8-062640 | 3/1996 | Japan . |
| 8-069017 | 3/1996 | Japan . |
| 8-069018 | 3/1996 | Japan . |
| 8-069019 | 3/1996 | Japan . |
| 8-069020 | 3/1996 | Japan . |
| 8-101371 | 4/1996 | Japan . |
| 8-248374 | 9/1996 | Japan . |
| 8-271910 | 10/1996 | Japan . |
| 8-271920 | 10/1996 | Japan . |
| 8-271934 | 10/1996 | Japan . |
| 8-297269 | 11/1996 | Japan . |
| 8-313878 | 11/1996 | Japan . |
| 8-320477 | 12/1996 | Japan . |

*Primary Examiner*—Amare Mengistu
*Attorney, Agent, or Firm*—Oblon, Spivak, McClelland, Maier & Neustadt, P.C.

[57] ABSTRACT

A liquid crystal display device includes a liquid crystal display cell having a layer of a twisted-nematic liquid crystal material with a positive dielectric anisotropy constant and constructed such that a plurality of voltage potentials applied to the liquid crystal cell may firstly induce a Freedricksz transition of the liquid crystal material and then select either one of first and second metastable states caused by relaxation of the liquid crystal material succeeding the Freedricksz transition. A first voltage potential is adjusted higher than a threshold voltage necessary to cause changes from an initial state to the metastable states, a second voltage potential to select one of the metastable states is adjusted in comparison with a voltage potential necessary to switch between the metastable states, and a third voltage potential is applied as a modulation voltage during or succeeding the application of the second voltage potential. By applying at least one of these voltage potentials, the modulation of the metastable states can be carried out, thereby causing arbitrary changes in transmittance of the liquid crystal cells and achieving a multilevel gray scale in the liquid crystal display device.

71 Claims, 11 Drawing Sheets

LIQUID CRYSTAL DISPLAY DEVICE

BACKGROUND OF THE INVENTION

1. Field of the Invention

This invention relates in general to liquid crystal display devices, and more particularly, to bistable twisted-nematic liquid crystal devices.

2. Discussion of the Background

Liquid crystals, which include ordered molecules or groups of molecules in a liquid state, are found to be considerably useful for fabricating devices for switching, modulating and otherwise altering characteristics of light beams. Differences in transmittance and in a polarizing effect of such liquid crystals both have been now utilized for, for example, liquid crystal displays for audio equipment, instrument panels and office automation equipment.

However, it would be more practical for a number of new applications to have a liquid crystal material which has two stable states, and which can easily transform from one stable state to the other, rapidly and with a minimum expenditure of energy.

To implement a high speed drive for liquid crystal devices, a variety of liquid crystal displays using bistable twisted-nematic liquid crystals have been disclosed as exemplified in Japanese Published Patent Application No. 1-51818 and Japanese Laid-Open Patent Application No. 6-230751.

Bistable characteristics are shown for twisted-nematic liquid crystals in these disclosures, in which at least two pulse voltages are applied to produce an electric field across a liquid crystal cell. A first pulse is used to initiate a Freedricksz transition of the liquid crystal and a second pulse is used to subsequently relax the liquid crystal into one of two metastable states, thereby modulating optical transmittance or reflectivity to be utilized for display devices.

Although principles for switching behavior of possible displays are presented in JP 1 -51818, no description is made on driving the displays. Also, JP 6-230751 proposes basics of driving simple matrix type displays. However, no description is made for a gray scale technique of display pixels, which is deemed essential to high quality liquid crystal displays.

In addition, Japanese Laid-Open Patent Application No. 8-313878 proposes a gray level modulation technique in which gray levels of display pixels may be obtained by applying pulse voltages to scan lines and by changing a ratio of two metastable states during a scan period. However, since the pulse voltages are applied to an entire scan line by the above technique, this results in the same gray level in display pixels on that scan line. Although a different gray level in an individual pixel on a single scan line may be feasible by (1) superposing on- and off-states in pixels and (2) modulating applied potentials over a plurality of display picture frames, a maximum transmittance (or reflectivity) intrinsic to a liquid display panel can be achieved only to a certain extent.

SUMMARY OF THE INVENTION

It is therefore an object of the present invention to provide a novel liquid crystal display which overcomes the above-noted difficulties.

It is another object of the present invention to provide a novel liquid crystal display device of high quality capable of achieving a high speed drive and acquiring gray levels in display pixels.

A further object of the present invention is to provide a novel liquid crystal display device capable of achieving gray level modulation of individual display pixels while maintaining a maximum transmittance.

To achieve the forgoing and other objects, and to overcome the shortcomings discussed above, in the present invention a novel liquid crystal display device having a liquid crystal display cell which is capable of being switched to either a first state or a second state is provided. The display cell includes a layer of a chiral nematic liquid crystal material having a positive dielectric anisotropy constant and a layer of liquid crystal molecules being gradually twisted in a predetermined manner between the transparent substrates. Further, first, second and third voltages are applied between the transparent electrodes and an electric field is provided across the liquid crystal cell, the first voltage being used to initiate a Freedricksz transition of the liquid crystal material, the second voltage being used to select one of the metastable states of the liquid crystal material, the metastable states being caused by the relaxation of the liquid crystal material succeeding the Freedricksz transition.

The first voltage may preferably be adjusted to be higher than a threshold voltage necessary to cause changes from an initial state to the metastable states, the second voltage to select one of the metastable states may be adjusted in comparison with a voltage potential necessary to switch a change from one of the metastable state to the other metastable state, and the third voltage may preferably be adjusted during or succeeding the application of the second voltage to be smaller than the threshold voltage, thereby resulting in a gray level modulation of the display cells.

The novel liquid crystal display device may further include alignment films disposed over the transparent electrodes, a surface of each of the alignment films being alignment treated, and polarizing plates may be provided relative to each of second major surfaces of the transparent electrodes.

Methods are also disclosed for carrying out the modulation of the metastable states and causing arbitrary changes in transmittance of the liquid crystal cells to thereby achieve a multilevel gray scale in the liquid crystal display device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
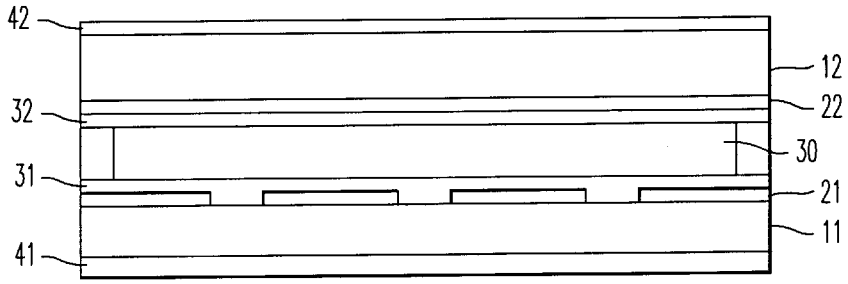
FIG. 1 is a cross-sectional view of a liquid crystal display device in accordance with the present invention.

In the description which follows, specific embodiments of the present invention useful in liquid crystal display devices, including twisted-nematic liquid crystal layers having a bistable character, are described.

It is understood, however, that the present invention is not limited to these embodiments. For example, it is appreciated that the construction and the fabrication methods of the liquid crystal display in the present invention are adaptable to any form of liquid crystal display device. Other embodiments will be apparent to those skilled in the art upon reading the following description.

In background bistable twisted-nematic liquid crystal display devices, a drive of display devices is carried out by applying drive voltage waveforms and by selecting one of two metastable states of liquid crystal molecules. Since each of the two metastable states correspond to either a bright or dark state of a display pixel, display devices with binary gray levels are typically achieved for background bistable twisted-nematic liquid crystals.

The present invention provides a liquid crystal display device including display cells with a bistable liquid crystal layer, in which at least one of two metastable states of the liquid crystal cell may electro-optically be modulated to achieve multi-level gray scale displays in the liquid crystal display device.

According to one aspect of the present invention, a liquid crystal display cell is formed, including a layer of a chiral nematic liquid crystal material having a positive dielectric anisotropy constant and constructed such that a plurality of voltages applied to the liquid crystal cell may firstly induce a Freedricksz transition of the liquid crystal material and then select either one of metastable states caused by relaxation of the liquid crystal material succeeding the Freedricksz transition. A first voltage may be applied higher than a threshold voltage necessary to induce a transition from an initial state to the metastable states, and a second voltage to select one of the metastable states may be applied in comparison with a voltage necessary to switch from one of the metastable state to the other metastable state. A third voltage may be applied as a modulation voltage during or succeeding application of the second voltage, thereby achieving the modulation of the metastable states and resulting in changes in transmittance of the display cells or display pixels.

According to another aspect of this invention, methods are disclosed for carrying out the modulation of metastable states and resulting in changes in transmittance of the liquid crystal cells by inputting gray level modulation voltages from signal electrodes of liquid crystal display cells.

The principles of a gray level modulation of a liquid crystal display cell of the present invention will be described hereinbelow.

The chiral nematic liquid crystal material of the present invention has two metastable states that are different from an initial state of the material. As an example, assuming the initial state has a twisted structure with 180° twist angle (ϕ), the liquid crystal material has two metastable states wherein its twist angle is either 0° for one metastable state or 360° for the other.

When polarizers are each positioned on upper and lower faces of the display cell with a 45° angle between the polarization axis of the polarizers and the alignment direction of the alignment layers, the above-mentioned 0° and 360° twist angles respectively correspond to bright and dark states of the display device, and are hereinafter referred to as a uniform (or on-) state and a twist (or off-) state.

The twist angle of the present invention is not necessarily limited to 180° as mentioned above, but other angles from 90° to 270° may also preferably be adopted.

During experimentation on various drive conditions, decreases in transmittance of display cells (or pixels) were found by applying modulation pulses to the pixels in the bright 0° metastable state (or uniform state). This finding has led to a gray level display by applying modulation pulses to signal electrodes of the display cells.

In addition, by driving the display device under conditions that the amplitude of applied pulses are adjusted to not induce a further switching to the other metastable state from the presently selected state, display cells having high transmission have been found to be modulated to result in excellent gray level characteristics.

By comparison with a background display method in which only one of two metastable states is selected and transmittance of that state alone is used, the method of the present invention utilizes two of these states.

Namely, to the liquid crystal molecules which have a molecular orientation corresponding to one of the metastable states, voltage pulses are applied during or following switching to the other metastable state, and the modulation of the molecular orientation in that state and concurrent changes in transmittance by inducing some perturbation effect involving the other metastable state may be achieved. Accordingly, the display device of the present invention is capable of providing arbitrary transmittance values other than those inherent to the unperturbed metastable states, which is characteristic to, and different from, background display devices.

Referring to the drawings, the present invention will described hereinbelow.

FIG. 1 is a cross-sectional view of a liquid crystal display device, having a bistable character, including a layer 30 of liquid crystals placed between a pair of opposing light transparent substrates 11, 12, which are provided with transparent electrodes 21, 22 for applying voltages and alignment films 31, 32 for aligning liquid crystals, and polarizers 41, 42.

Transparent substrates 11, 12 support the lineated transparent electrodes 21, 22, as well as provide a structure for containing the layer of liquid crystal material 30. Each substrate 11, 12 is composed primarily of a transparent dielectric material such as glass, plastics, or the like.

The alignment films 31, 32 are formed by coating layers of polyimide (AL-3 from Nihon Synthetic Rubber Co). Surfaces of the alignment films 31, 32 were subsequently alignment treated by, for example, rubbing the surfaces in a uniform direction to have a respective alignment direction for defining surface alignment of the direction of liquid crystal material 30.

In the present invention, a liquid crystal material is preferably used, including a chiral nematic liquid crystal material, having a positive dielectric anisotropy and a ratio of its intrinsic pitch to the liquid crystal cell thickness of from about 1.0 to 2.2.

Using the aforementioned alignment films 31, 32, liquid crystal molecules in the cell are tilt-aligned so as to have a slight angle of inclination relative to the face of the substrates 11, 12 and the angles of inclination relative to each of the substrates 11, 12 to have the opposite sign. The angle of the inclination is preferably from 2° to 30°.

It has been found that, for inclination values smaller than the above-mentioned, the bistability of the liquid crystal material becomes less stable to result in a less satisfactory switching behavior, while an undesired increase in viewing angle dependence of the display quality results for larger values of the inclination.

In the present invention, the liquid crystal cells may also preferably have a Δnd value of about one half of a light wavelength presently used for viewing the display, or from 0.20 to 0.35 micron and more preferably from 0.25 to 0.3 micron, wherein Δn and d represent an optical anisotropy value of the liquid crystal material and a thickness of the liquid crystal layer 30, respectively.

The two polarizers 42, 41 are each disposed on the top and bottom faces of the cell substrates 12, 11. The direction of transparency axis of one of the top and bottom polarizing plates is arranged to have an angle of about 45°, or of from 35° to 55°, between the alignment direction of an underlying alignment film, while the direction of transparency axis of the other polarizing plate is arranged to be symmetric with respect to the alignment direction.

As a plurality of voltages to be applied to drive the above prepared liquid crystal display device, voltages in pulse forms will be described firstly hereinbelow, which are applied to induce a Freedricksz transition of the liquid crystal material, to select either one of metastable states caused by relaxation, and modulate light transmittance by perturbing the metastable states. It is needless to note that the voltage forms of the present invention are not necessarily limited to pulse forms.

The drive pulse voltages include (1) a pulse voltage to induce a Freedricksz transition of the liquid crystal material, which is hereinafter referred to as a "reset pulse", and (2) a pulse voltage to select either one of the metastable states caused by relaxation subsequent to the Freedricksz transition, which is referred to as a "second pulse".

The amplitude of the reset pulse may be adjusted to be larger than a threshold voltage necessary to cause changes from an initial state to the metastable states and the second pulse may be adjusted in comparison with a voltage necessary to switch from one of the metastable states to the other metastable state. These reset and second voltages may also be unipolar as well as bipolar. The unipolar pulses may be applied by changing their polarity periodically for a liquid crystal layer not to suffer from the accumulation of electric charges.

The change in optical transmittance of a liquid crystal device of the bistable twisted-nematic type with the application of pulse voltages is illustrated in FIG. 2, wherein reset and second pulses are primarily examined.

As mentioned above, second pulses are applied to select either one of metastable states which result by a relaxation process from a state resulting from the Freedricksz transition (or a reset state). In the reset state, liquid crystal molecules are arranged in a homeotropic order.

When an amplitude of a second pulse is smaller than a critical value, a reversed rearrangement (or backward flow) in the molecular orientation takes place due to a rapid relaxation and the molecules become twisted further by 180° from an initial arrangement. Namely, if the initial twist angle is 180°, this rearrangement results in a 360° twist angle, which is approximately the same angle as that of the aforementioned metastable state with a 360° twist angle. This 360° twisted state is hereinafter referred to as a T-metastable state and gives rise to a dark state of the display device of the present construction including the alignment of the polarizers 41, 42.

By contrast, when the amplitude of a second pulse is larger than the critical value, the reversed rearrangement is suppressed and the molecules become stable at a twist angle smaller by 180° from an initial arrangement. Namely, for the 180° initial twist angle, this rearrangement results in a 0° twist angle, which is approximately the same angle as that of the other metastable state with a 0° twist angle. This 0° or untwisted state is hereinafter referred to as U-metastable state and gives rise to a bright state of the display device.

Following the previous description on the transmittance change with various pulse voltages, there will be described other characteristic changes in optical transmittance caused by second pulses which are applied immediately after or a certain elapsed time after a reset pulse.

As mentioned above, the U-metastable state gives rise to a bright state of the display device of the present construction including the alignment of the polarizers 41, 42. When an additional pulse voltage is further applied after the select pulse, a transmittance value which is smaller than that for the U-state can be obtained.

This process can be considered as follows. During or immediately after the relaxation from the reset state, liquid crystal molecules are under a restraining force for the molecular axis to cause an orientation perpendicular to the substrates 11, 12. As a result, the molecules tend to orient with a larger angle to the substrates 11, 12, and to thereby result in a transmittance value smaller than that of the U-metastable state, which are correlated to the gray scale of the liquid crystal display cell.

Figure 3:
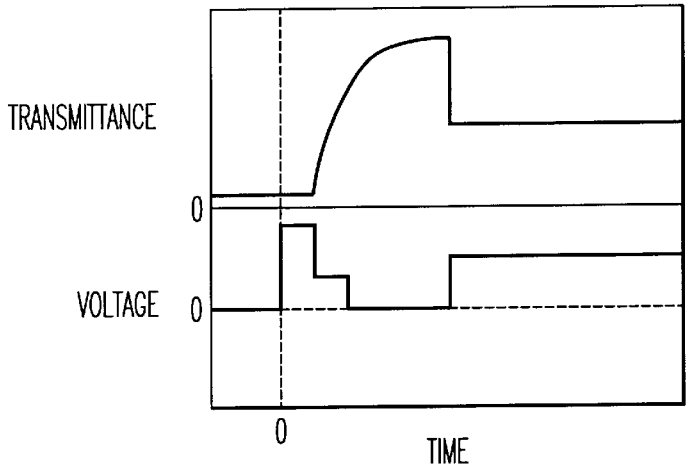
FIG. 3 is a graph of cell transmittance as a function of time, illustrating an application of gray level modulation voltages with a constant amplitude succeeding unipolar reset and second pulses.
Figure 4:
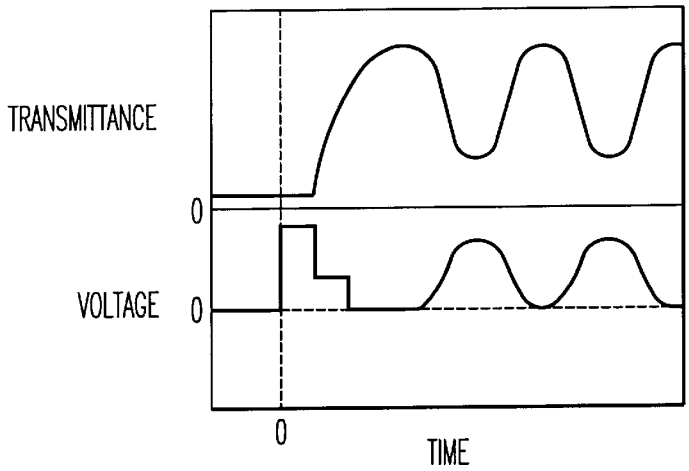
FIG. 4 is similar to FIG. 3 except that the gray level modulation voltage is a sinusoidal function with time.

In addition, successive changes in the orientation angle and concurrent optical transmittance are determined by the amplitude of subsequent voltages (or gray level modulation voltages) which are applied succeeding the second pulse: (1) when the amplitude of a subsequent gray level modulation voltage is unchanged with time, transmittance of the liquid crystal cell is unchanged as shown in FIG. 3, and (2) for a modulation voltage having a waveform continuously changes with time. The changes in transmittance with time are shown in FIG. 4.

When a modulation voltage with an amplitude larger than that of the reset pulse (i.e., larger than the threshold voltage necessary to cause changes from an initial state to the metastable states) is applied, a transition to the dark metastable state is induced upon the removal of the modulation voltage. It should be noted, therefore, that it is necessary for an applied modulation pulse to have an amplitude smaller than that of the above-mentioned threshold voltage in order to arbitrarily control the transmittance of the display cell.

Figure 5:
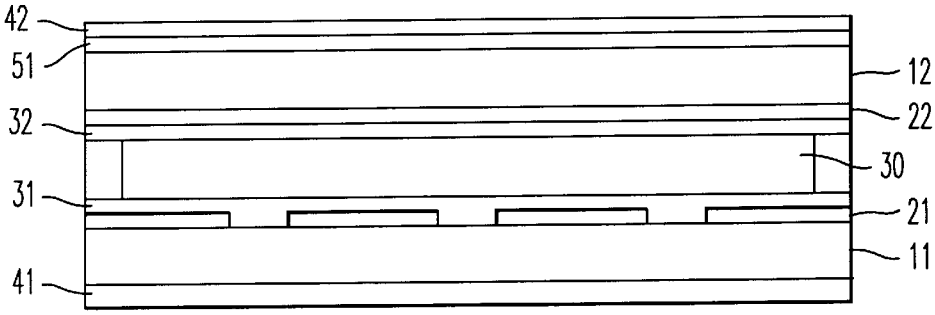
FIG. 5 is a cross-sectional view of a liquid crystal display device in accordance with the present invention, wherein a quarterwave plate is further provided over a polarizer.

With the above-mentioned construction of the display device including the alignment of the polarizers 41, 42 (FIG. 1), the T- and U-metastable states respectively give rise to dark and bright states of the display device. However, these states may also be assigned conversely with other constructions of the display. For example, by further providing a display device with a quarter-wave plate 51, as shown in FIG. 5, between one of the polarizers 42 and the adjacent substrate 12, with a retardation axis thereof orthogonal to the alignment direction of the polarizer 42, the U- and T-metastable states respectively can be correlated to dark and bright states of the display device.

Figure 6A:
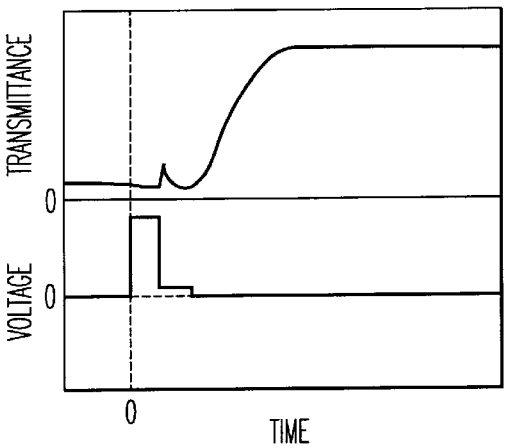
FIG. 6*a* is a graph of cell transmittance as a function of time comparing transmittance and pulse voltages for a display cell having a bright T-metastable state.
Figure 6B:
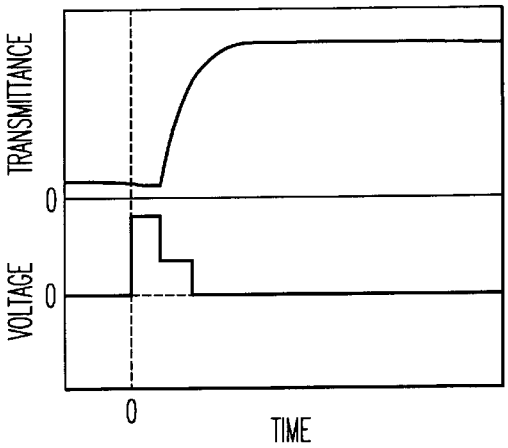
FIG. 6*b* is similar to FIG. 6*a* except for a display cell having a bright T-metastable state.

Although the above-mentioned two constructions are feasible for assigning the dark and bright states, one with the bright U-metastable state is preferred for the following reasons. Since the transition from the reset state to the T-metastable state proceeds through the reversed rearrangement in the molecular orientation due to a rapid relaxation as stated earlier, it generally takes longer to complete the transition and to realize a concurrent transmittance as shown in FIG. 6*a*. By contrast, the transition to the U-metastable state proceeds with almost no affect of the reversed rearrangement, thereby converging to a concurrent transmittance value by a relatively short period of time (FIG. 6*b*) . Therefore, by correlating the U-metastable state to the bright display state, it becomes feasible for a succeeding gray level modulation voltage to be applied more immediately after the second pulse and to acquire more flexibility in the manner of the modulation voltage application. In addition, it is more advantageous for this construction not to have an additional phase plate, leading to a simpler construction of the display device.

In the display device of the present invention, a more efficient control of transmittance may become feasible by applying gray level modulation voltages in pulse forms to the display cell.

Figure 7A:
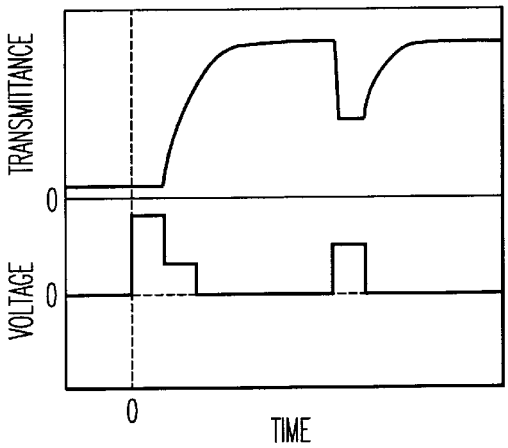
FIG. 7*a* is a graph of time average transmittance as a function of time comparing transmittance and pulse voltages, illustrating an application of a gray level modulation pulse voltage carried out after a certain elapsed time succeeding completion of a bright state by reset and second pulses.
Figure 7B:
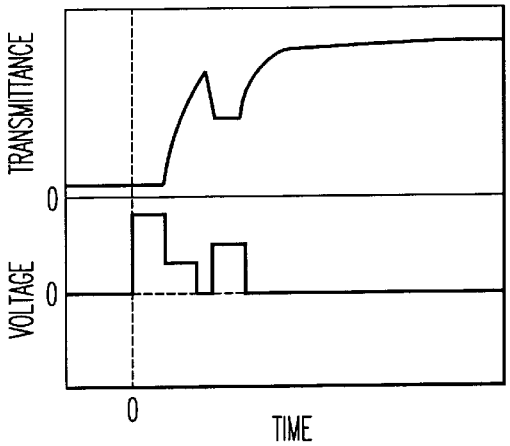
FIG. 7*b* is similar to FIG. 7*a* except an application of a gray level modulation pulse voltage is carried during a transition to, or prior to completion of, a bright state.

Referring to FIGS. 7*a* and 7*b*, there is illustrated a change in optical transmittance with time resulting from the application of a plurality of pulse voltages, such as a reset pulse to induce a Freedricksz transition, a succeeding second pulse to select the bright U-metastable state, and further succeeding gray level modulation pulses.

The axis arrangement of liquid crystal molecules which are either in the U-metastable state already or during the transition process to the U-metastable state, is influenced by applied gray level modulation pulses, and a transmittance value of the display cell is typically decreased. However, upon the completion of the modulation pulse, the molecules initiate a return to the U-state, and thereby a concurrent recovery results in the transmittance value to that in the bright state. That is, a temporary decrease in transmittance is feasible for the liquid crystal molecules which are either in the U-metastable state (FIG. 7*a*) or during the transition process to the U-metastable state (FIG. 7*b*). In other words, this indicates that it becomes feasible to control average transmittance (i.e., time average of the observed transmittance) of the liquid crystal cells depending on the conditions of the modulation pulse application.

As mentioned above, the amplitude of the applied modulation pulse is preferably smaller than that of the threshold voltage in order to arbitrarily control the transmittance value of the display pixel, since a transition to the dark T-metastable state is induced for an amplitude larger than the threshold voltage.

The aforementioned changes such as a temporary decrease and succeeding recovery in transmittance are thus able to give rise to the modulation of average pixel transmittance. Since the two metastable states of the bistable twisted-nematic type liquid crystals have memory properties, the display devices can be driven at a relatively low frequency (or low frame frequency). Although a plurality of modulation pulses may be applied between neighboring reset pulses, time intervals for these modulation pulses are preferably adjusted to be less than 40 milliseconds, and more preferably less than 30 milliseconds, for flickers on the display not to be visually recognized.

A variety of methods of applying gray level modulation pulses to control average transmittance of the display devices of the present invention will be described hereinbelow.

(a) Modulation pulses various in widths.

Figure 8A:
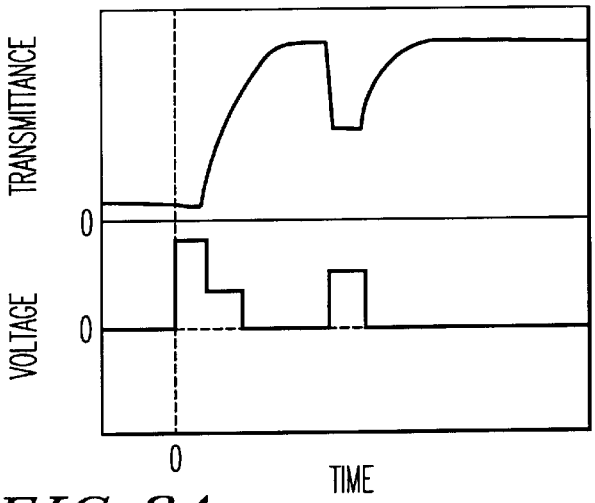
FIG. 8*a* is a graph of time average transmittance as a function of time comparing transmittance and pulse voltages, illustrating an applied gray level modulation pulse voltage having a pulse width of a predetermined magnitude.
Figure 8B:
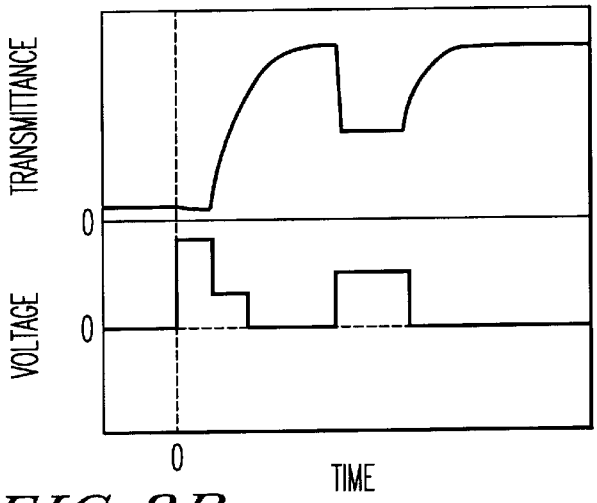
FIG. 8*b* is similar to FIG. 8*a* except that an applied gray level modulation pulse voltage has a pulse width larger than a predetermined magnitude.
Figure 8C:
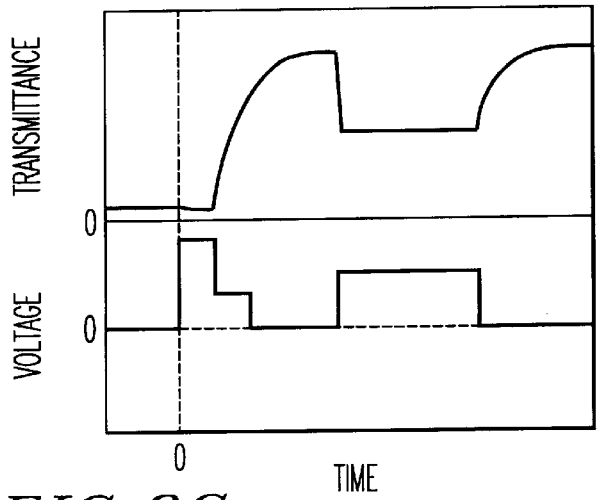
FIG. 8*c* is similar to FIG. 8*b* except that an applied gray level modulation pulse voltage has a pulse width still larger than that of FIG. 8*b;*

Referring to FIG. 8, changes in transmittance with varying pulse widths are illustrated, wherein a second pulse is applied succeeding a reset pulse to a display pixel so as to select a bright U-metastable state and modulation pulses are further applied having a variety of pulse widths.

It is indicated that the pulse width of the modulation voltage is varied, different time durations for the decrease in transmittance result, thereby leading to the change in average transmittance of pixel. The maximum number of gray levels may therefore be obtained to be as many as the number of feasible pulses. In practice, the pulse widths are arbitrarily determined as the combination of a variety of predetermined widths.

(b) Modulation pulses various in amplitudes.

Figure 9A:
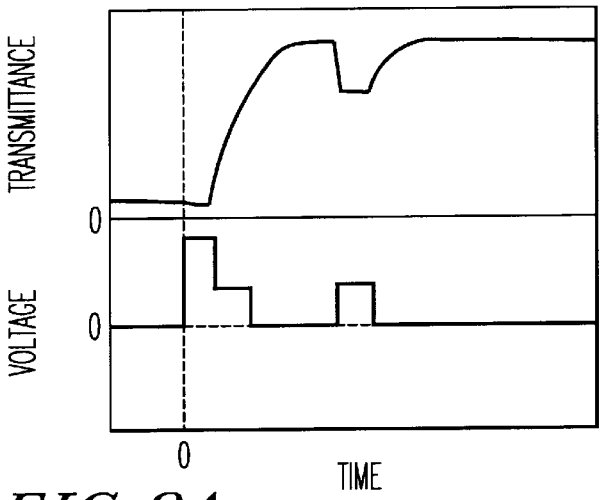
FIG. 9*a* is a graph of time average transmittance as a function of time comparing transmittance and pulse voltages, illustrating an applied gray level modulation pulse voltage having a pulse amplitude of a predetermined magnitude.
Figure 9B:
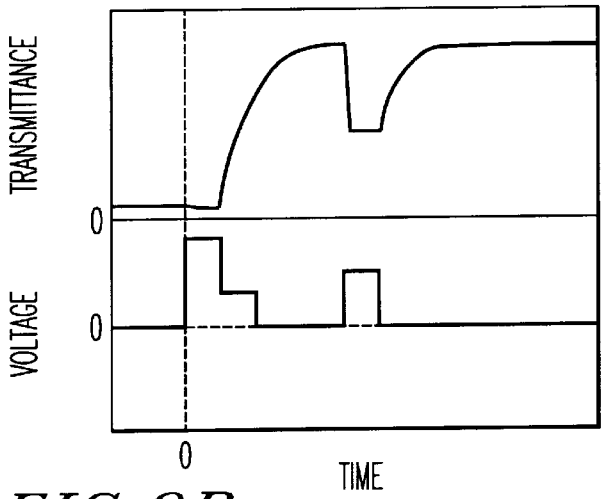
FIG. 9*b* is similar to FIG. 9*a* except an applied gray level modulation pulse voltage has a pulse amplitude larger than a predetermined magnitude.
Figure 9C:
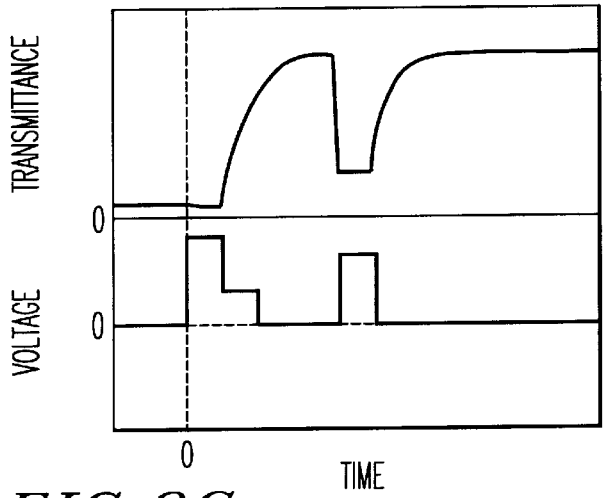
FIG. 9*c* is similar to FIG. 9*b* except an applied gray level modulation pulse voltage has a pulse amplitude still larger than that of FIG. 9*b;*

Referring to FIG. 9, changes in transmittance with varying pulse amplitudes are illustrated, wherein a second pulse is applied succeeding a reset pulse so as to select a bright U-metastable state and modulation pulses are further applied having a variety of pulse amplitudes.

It is indicated that the decrease in transmittance results with the increase in the pulse amplitudes, thereby leading to the change in average transmittance. The maximum number of gray levels may therefore be obtained to be as many as the number of feasible pulses. To be more specific, the pulse amplitudes are arbitrarily determined as the combination of a variety of predetermined amplitudes.

(c) Modulation pulses various in time periods from the second pulse.

Figure 10A:
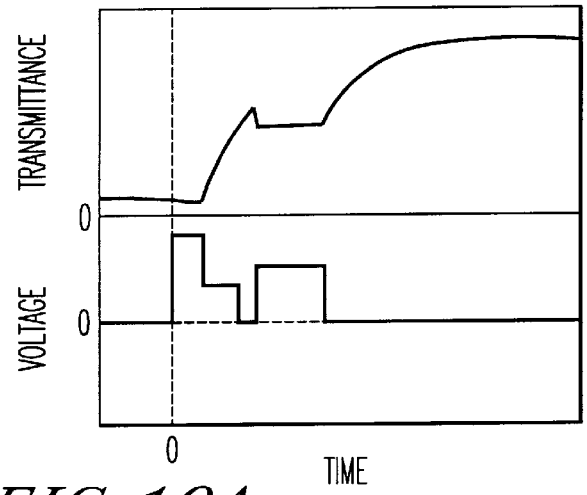
FIG. 10*a* is a graph of time average transmittance as a function of time comparing transmittance and pulse voltages, illustrating an application of a gray level modulation pulse voltage carried out after a certain elapsed time succeeding completion of a bright state by reset and second pulses.
Figure 10B:
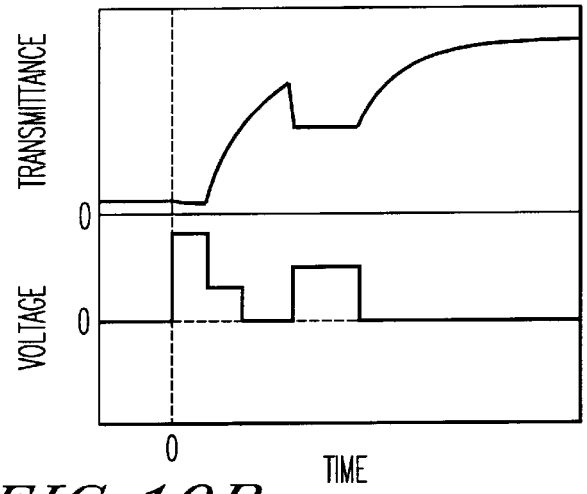
FIG. 10*b* is similar to FIG. 10*a* except that a certain elapsed time is longer than that of FIG. 10*a;*
Figure 10C:
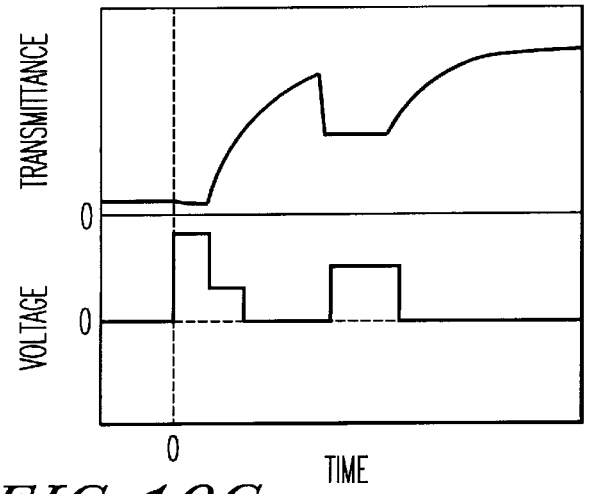
FIG. 10*c* is similar to FIG. 10*b* except that a certain elapsed time is still longer.

Referring to FIG. 10, the change in transmittance with varying a time period from a second pulse are illustrated, wherein a second pulse is applied succeeding a reset pulse to select a bright U-metastable state and modulation pulses are further applied after a certain elapsed time from the start of the second pulse.

The liquid crystal display devices are generally driven by applying one set of voltages with a predetermined waveform in a frame period. In bistable twisted-nematic type display devices, a display drive is typically carried out by "rewriting" display contents once a frame period by applying each one of a reset pulse and second pulse in a single frame period. During the rewriting, flickers on the display devices may be observed depending on the drive conditions.

Since the frame frequency is generally selected from 40 to 50 hertz for the flickers not to be recognized, the frame period becomes approximately from 20 to 25 milliseconds. It takes about 20 milliseconds for liquid crystal molecules to return to the U-metastable state after reset and second pulses, and it also takes approximately the same time after modulation pulses. The changes in transmittance therefore result with modulated transmittance values depending on the timing of the application of modulation pulses.

(d) Modulation pulses various in both time periods from second pulses and pulse widths.

Above-mentioned two variables in the modulation pulse application may also be employed in combination to control transmittance more effectively. For example, although modulation pulses which vary in each of widths and time periods from the start of second pulses are described respectively above, pulses which vary in both of the width and time period may also be effectively employed, thereby resulting in the maximum number of gray levels to be as many as the product of the feasible values of the aforementioned variables.

(e) Modulation pulses various in both time periods from second pulses and pulse amplitudes.

Above-mentioned two variables in the modulation pulse application may be employed in combination to control transmittance more effectively. For example, although modulation pulses which vary in each of amplitudes and time periods from the second pulse are described respectively above, pulses which vary in both of the amplitude and time period may also be effectively employed, thereby resulting in the maximum number of gray levels to be as many as the product of feasible values for the aforementioned two variables.

(f) Modulation pulses various in all three of time periods from second pulses, pulse widths and pulse amplitudes.

The above-mentioned three variables in the modulation pulse application may also be employed in combination to control transmittance more effectively. For example, although modulation pulses which vary in each of widths, amplitudes, and time periods from the start of second pulses are described respectively above, pulses which vary in all three of the widths, amplitudes, and time periods may also be effectively employed, thereby resulting in the maximum number of gray levels to be as many as the product of feasible values for the aforementioned three variables.

Referring now to FIGS. 11 through 15, there will be described pulse application methods which are particularly useful for practical applications for achieving a gray scale display through modulating transmittance of at least one of the metastable states by applying gray level modulation signals to signal electrodes of the liquid crystal cells.

Figure 11A:
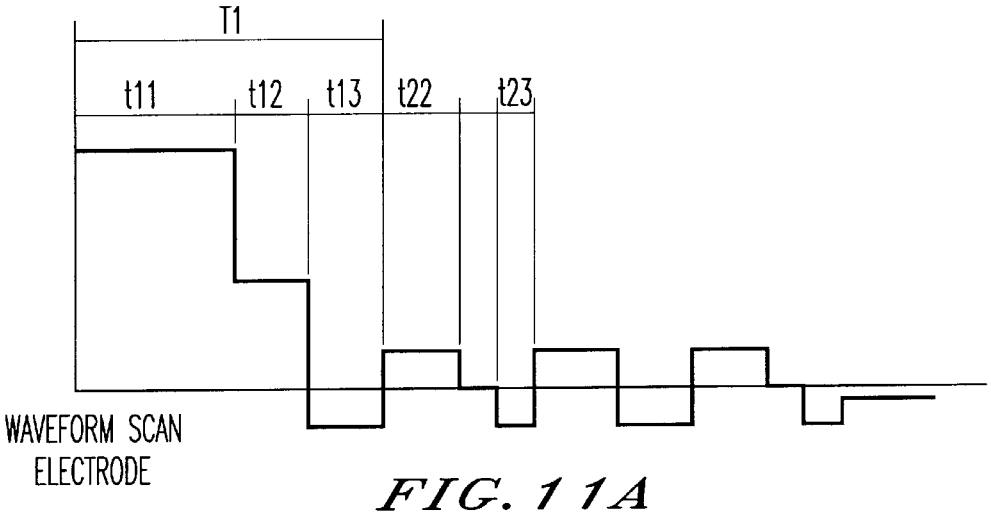
FIG. 11*a* is a graph of a waveform with time, output from a scan drive unit to carry out a gray level modulation.
Figure 11B:
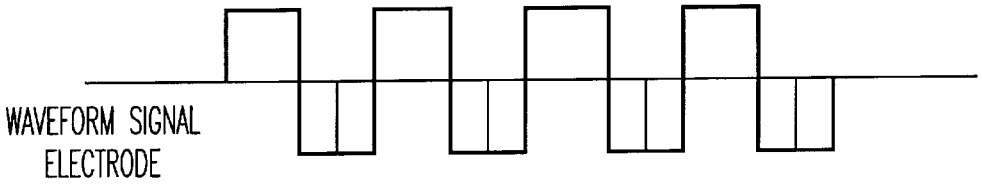
FIG. 11*b* is a graph of a waveform with time, output from a signal drive unit to carry out gray level modulation.
Figure 11C:
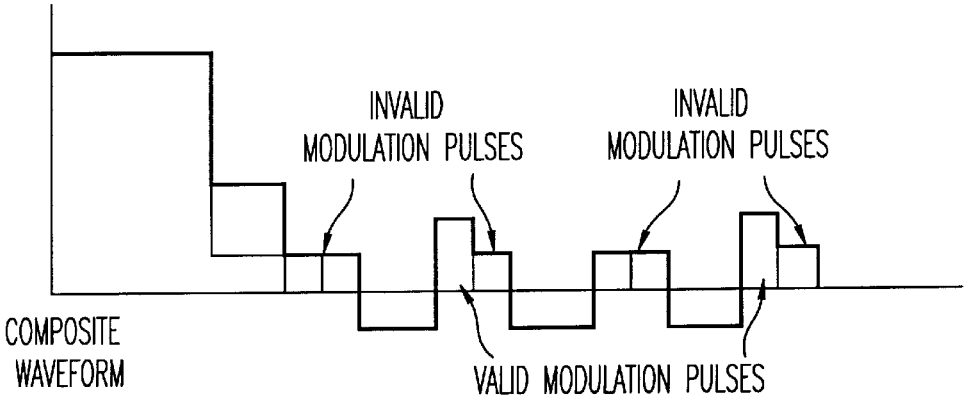
FIG. 11*c* is a graph of a composite of waveforms of FIG. 11*a* and FIG. 11*b;*
Figure 12A:
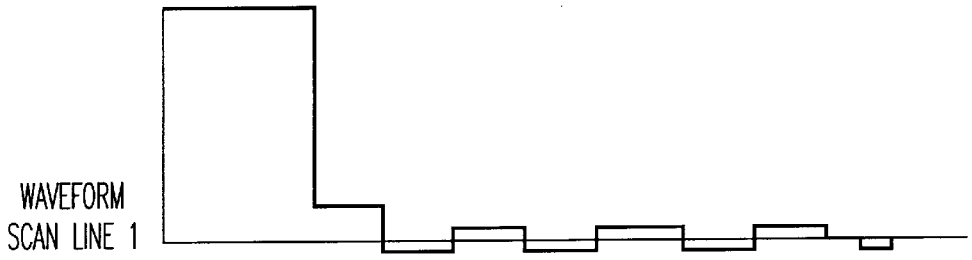
FIG. 12*a* is a graph of a waveform with time, input to a scan line 1.
Figure 12B:
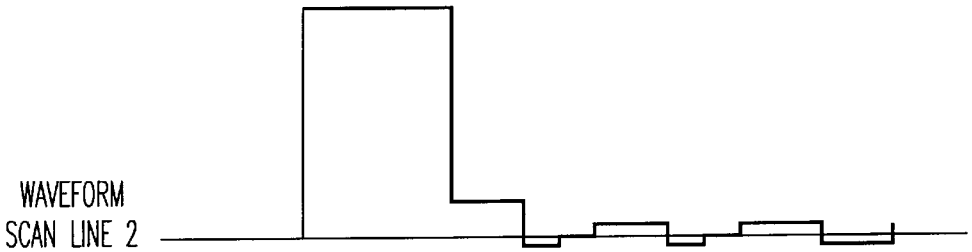
FIG. 12*b* is a graph of a waveform with time, input to a scan line 2.
Figure 12C:
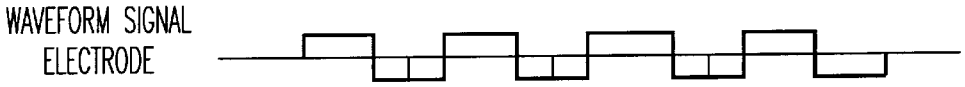
FIG. 12*c* is a graph of a composite of waveforms of FIG. 12*a* and FIG. 12*c*, which is valid on a scan line 1.
Figure 12D:
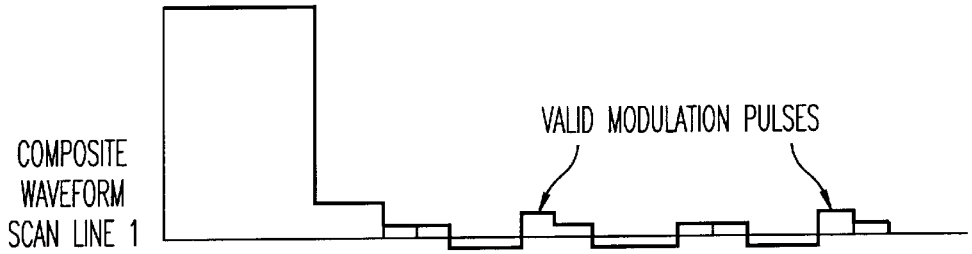
FIG. 12*d* is a graph of a composite of waveforms of FIG. 12*a* and FIG. 12*c*, which is valid on a scan line 1.
Figure 12E:
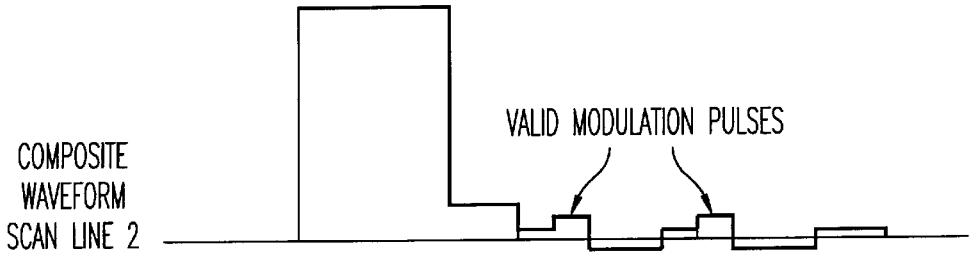
FIG. 12*e* is a graph of a composite of waveforms of FIG. 12*b* and FIG. 12*c*, which is valid on a scan line 2.

FIG. 11 illustrates drive voltage waveforms of gray level modulation signals applied to signal electrodes of the liquid crystal cells for achieving a gray scale display through modulating transmittance of at least one of the metastable states.

The voltage waveforms in FIG. 11 are intended to be exemplary and some of their widths or amplitudes are drawn with a certain exaggeration for illustration purposes.

As shown in FIG. 11, a scan period T1 includes time periods such as t11 for a first pulse to induce a Freedricksz transition of a liquid crystal, t12 for a second pulse to input an on/off signal to a scan electrode, and t13 for inputting a modulation signal to a signal electrode of the cell. In the present example, there is also included in period t13 inputting pulse voltages to invalidate some of the gray level modulation signals through a scan electrode of the cell.

Subsequent to the above-mentioned period, t22 is a period to input on/off data signals to a cell electrode on other scan lines, and first and second halves of a period t23 are to input voltage pulses to validate or to invalidate some of gray level modulation signals, respectively. Namely, a pixel is brought into a transmissive state by t12, the transmittance (or reflectivity) of the pixel is retained during t13 and is decreased during the first half of the pulse t23. As exemplified by the present example, it is clearly indicated that a scan line may be arbitrarily selected for a modulation signal to be input and that the gray scale display in an individual pixel on a scan line becomes feasible by applying modulation signals through signal electrodes.

It may be noted at this point that methods of the gray level modulation pulse application of the present invention are not limited to the above description. For example, an on- or off-signal may also preferably be input to a pixel on a selected scan line through a signal electrode, which is followed by the application of modulation signals to pixels on the selected scan line and by the succeeding application of modulation signals to pixels on other scan lines.

A further example of drive voltage waveforms of gray level modulation signals which are applied to liquid crystal cells is illustrated in FIG. 12, wherein a variety of waveforms on each of scan lines 1 and 2 with gray level modulation signals input on a single signal line are shown for a case in which first pulses of the first and second scan lines partially overlap for the purpose of demonstrating as many as possible composite waveforms.

It is clearly shown in FIG. 12 that switching between effective and void modulating pulses may be arbitrarily carried out for composite waveforms on both the first and second scan lines by modifying gray level modulation signals input from the signal line with different signal waveforms on the first and second scan lines.

In addition, although modulation pulses only are input to one of signal lines as in the previous description, it may be noted that the contents of modulation pulses and the second pulse including the on/off signal may preferably be changed depending on information data to be displayed.

As indicted earlier, a scan line on which a plurality of modulation signals are made effective for display pixels is selected by the combination of the modulation signals and signals from scan lines in the present invention. Although two modulation signals are input during one scan period in the previous example, it may be noted that the number of the modulation signals is not limited as described above. For example, a plurality of modulating pulses may preferably be input and utilized to modulate a plurality of pixels in a single frame by selectively inputting pulse waveforms in a different timing as mentioned above.

The number of possible modulation signals during a scan period may be determined depending on the frame frequency, the number of scan lines of the liquid crystal display panel and the width of the second pulse necessary to induce a transition between metastable states of the liquid crystal. In addition, the width and the number of modulation signals as well as the width of the second pulse may further be considerably increased by overlapping a start timing of the first pulse as illustrated in FIG. 12.

An example of a controller of the liquid crystal display device and its capability will now be described.

Figure 13:
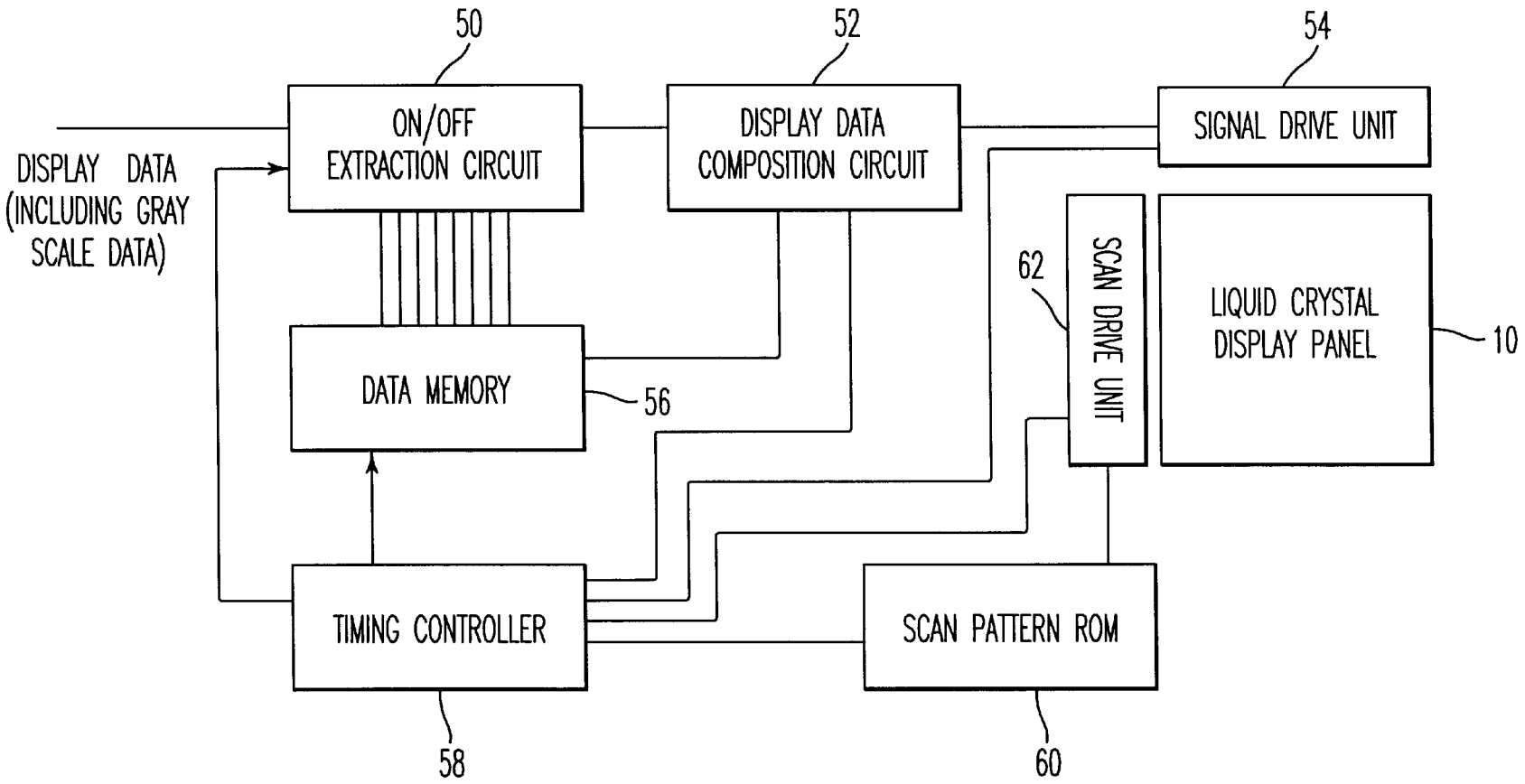
FIG. 13 is a block diagram of control architecture for controlling a liquid crystal display device in accordance with the present invention.

FIG. 13 includes a block diagram of the controller of the present invention. In FIG. 13, gray scale data are stored in a data memory unit 56 and is subsequently output to corresponding display pixels at a predetermined timing of the scan sequence based on a control from a timing controller 58. Display data including the gray scale information are fed to an on/off data extraction circuit 50. The display data which contains gray scale information, maximum transmittance and/or reflectivity information are extracted by this circuit by excluding off data, and is then output as on-data signals, through display data composition circuit 52 and signal drive unit 54 to LCD panel 10.

The on-data are utilized to input (or write) on-state commands into display pixels to thereby achieve appropriate driving of the display device using at least a first voltage potential to initiate a Freedricksz transition and a second pulse to subsequently relax into one of two metastable states, as mentioned above.

In the present method of the display drive, a gray level modulation of the display device is carried out by storing image display data including gray scale information in a data memory unit 56 and subsequently outputting the data to respective display pixels on a plurality of scan lines including a currently selected scan line.

During the above process, on/off data for each of sequential scan lines together with gray scale data for display pixels on other scan lines than the currently selected scan line are input as sequential data to ICs of a signal driving unit, and are then output to display pixels.

A scan driving unit 62 of the display system outputs validating signals to scan lines which adequately correspond to gray scale data output from the signal driving unit 54, while the unit outputs invalidating signals to other scan lines.

When a data pattern for outputting various signals from the scan driving unit 62 is fixed, scan signals may be generated with relative ease by outputting scan data from a scan pattern ROM 60 connected to scan drive unit 62. It may be noted that outputting the scan data is not limited to data generation by the ROM memories mentioned above, but the outputting may also preferably be carried out by logic synthesis using combinational circuits.

When scan data from the scan drive unit 62 are output, the scan data may be updated by referring to gray level modulation signals in synchronous with the scan data output from the signal drive unit 54. Namely, an output sequence of gray level modulation signals are altered with a high degree of flexibility depending on, for example, an order of input data, a number of gray level modulation steps and a variation with time. This may preferably be achieved using image data output from memories for the image storage by, for example, arithmetic elements in CPUs or a sequencer with combinational circuits.

Figure 14:
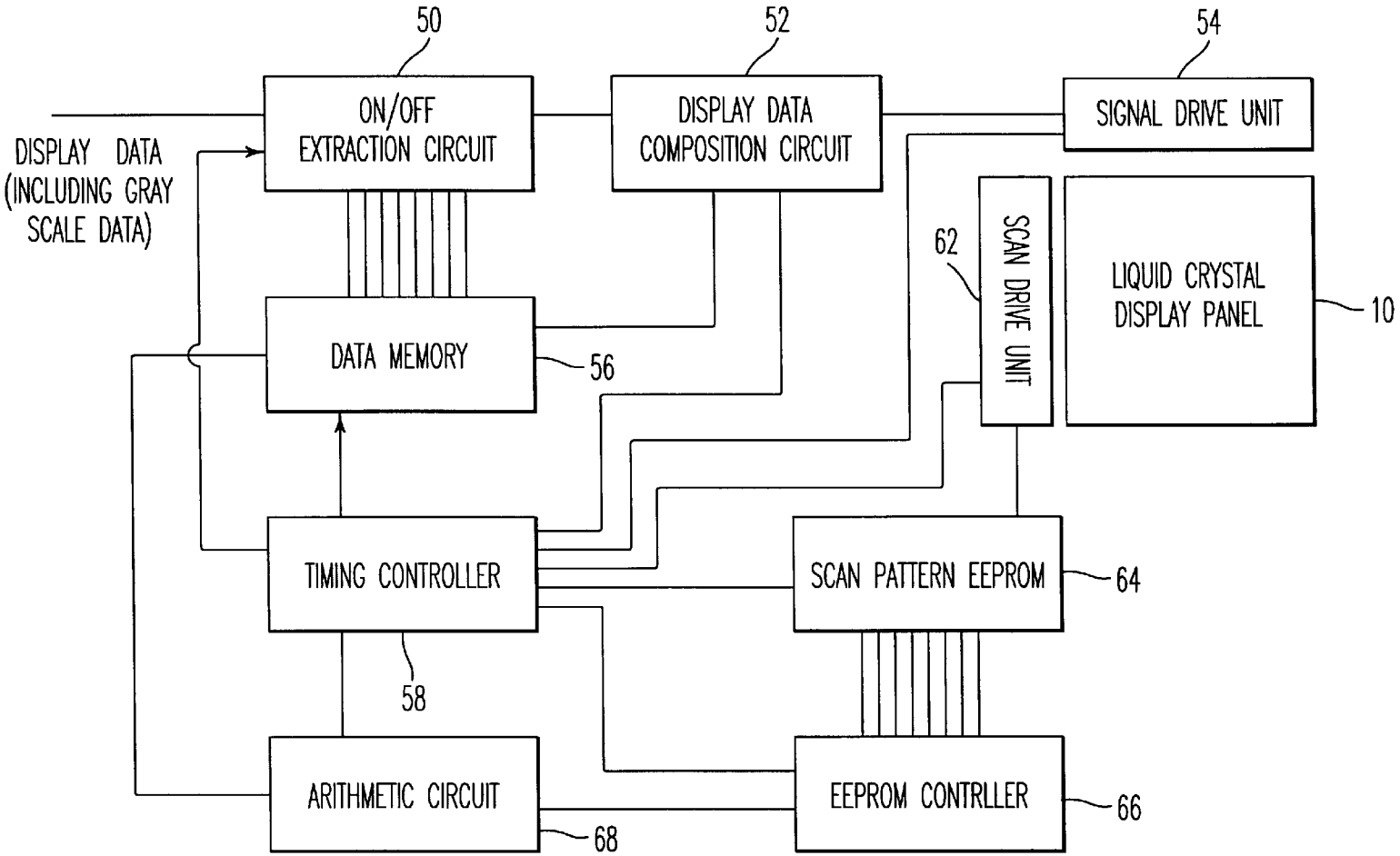
FIG. 14 is a further block diagram of control architecture for controlling a liquid crystal display device in accordance with the present invention.
Figure 15:
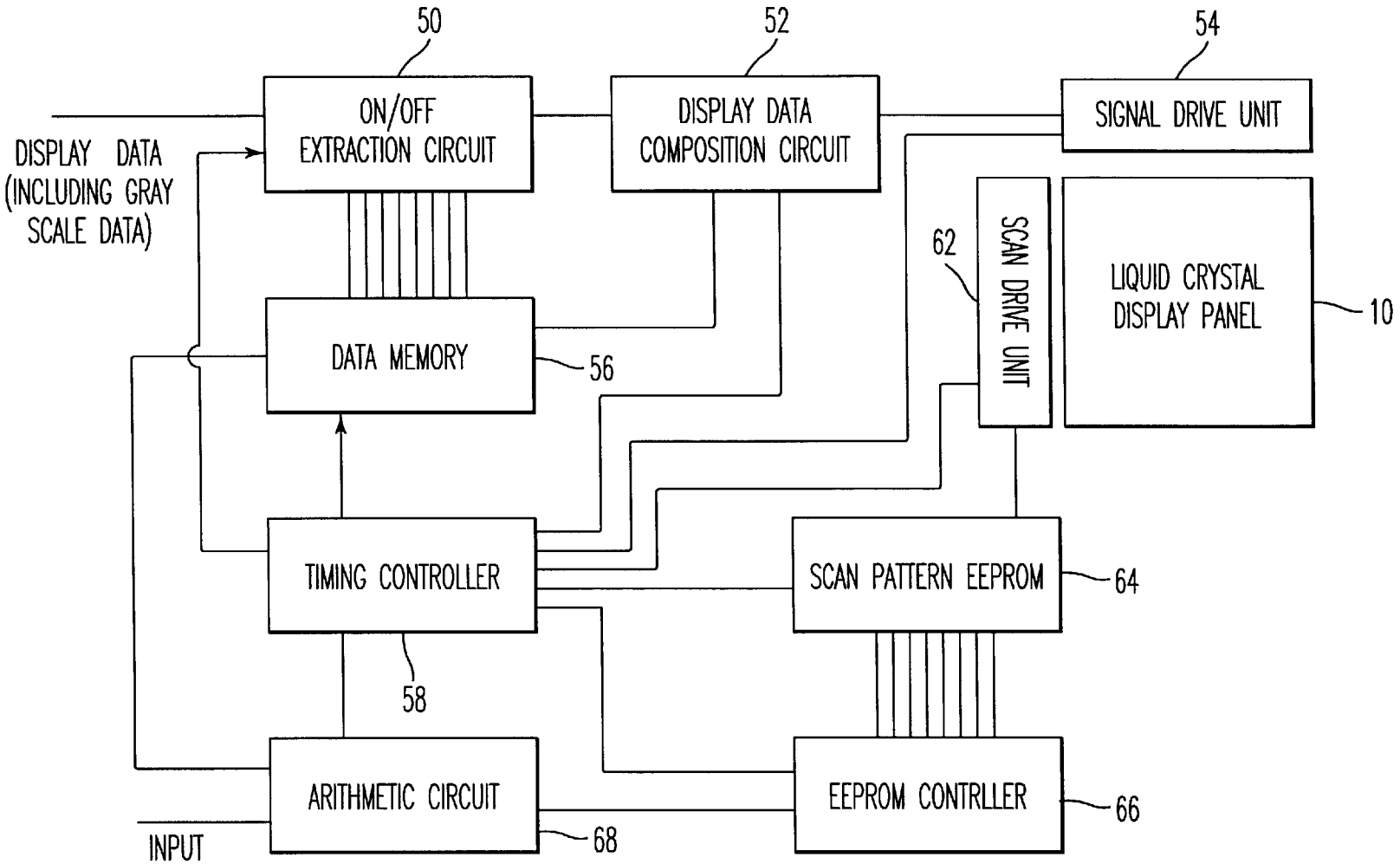
FIG. 15 is a still further block diagram of control architecture for controlling a liquid crystal display device in accordance with the present invention.

In addition, it may also preferably be carried out for a display user to alter an output sequence of the gray level modulation data in place of referring to the order of input data, as stated earlier. Namely, gray level modulation data may be output in an arbitrary sequence with relative ease by externally altering scan data to the scan unit, wherein the scan data to the scan unit may preferably be compiled in alterable memories such as, for example, electrically alterable EEPROMs or flash ROMS. For example as shown in FIGS. 14 and 15, scan pattern ROM 60 can be replaced with scan pattern EEPROM 64, EEPROM controller 66 and arithmetic circuit 68.

When the above-mentioned arithmetic circuit 68 or in CPUs or a sequencer are utilized, data ROMS used for referring registers in the CPUs and ROMS for storing branching instructions may preferably be composed of alterable memories such as, for example, electrically alterable EEPROMs 64 or flash ROMS.

Examples of waveforms from signal driving unit 54, including display and gray level modulation signals, and from scan drive unit 62 are illustrated hereinbelow. This illustration will be made for a case of a display device system which has 240 scan lines and is input with gray level modulation signals having 4 pulses a frame period.

The relationship is illustrated in Table 1, between (1) the number of a selected scan line and (2) the number of a scan line to which each of the 4 gray level modulation signals is input through signal lines and to which the gray level modulation signals are made valid.

The scan line number in the Table 1 denotes the number of the scan line which is presently selected and display trigger signals for on/off data to be output to a selected scan line. Gray level modulation signals 1 through 4 trigger to output a respective gray level modulation signal pulse to each corresponding pixel on a selected scan line. In Table 1, the numbers of the above-mentioned scan lines are shown.

Typically, a display signal for the scan line 1 triggers an on/off data pulse to be output to the selected scan line No. 1, and gray level modulation signals 1, 2, 3 and 4 each trigger to output gray level modulation pulses to corresponding pixels on the scan lines 194, 146, 98 and 50, respectively, as shown in Table 1.

Each of the above signals are output in series. Therefore, data pulses on the scan lines other than on selected lines are made ineffective by generating offset voltage waveforms on each non-selected scan lines, while voltage waveforms which validate incoming gray level modulation signals are generated on selected scan lines in synchronous to corresponding gray level modulation signals, thereby achieving a gray level modulation of pixels on the scan line.

TABLE 1

Scan Line, and Display and Gray Level Modulation Signals

| Scan line | Display | Gray level modulation signal | | | |
|---|---|---|---|---|---|
| No. | signal | 1 | 2 | 3 | 4 |
| 1 | 1 | 194 | 146 | 98 | 50 |
| 2 | 2 | 195 | 147 | 99 | 51 |
| 3 | 3 | 196 | 148 | 100 | 52 |
| 47 | 47 | 240 | 192 | 144 | 96 |
| 48 | 48 | 1 | 193 | 145 | 97 |
| 49 | 49 | 2 | 194 | 146 | 98. |
| 95 | 95 | 48 | 240 | 192 | 144 |
| 96 | 96 | 49 | 1 | 193 | 145 |
| 97 | 97 | 50 | 2 | 194 | 146 |
| 143 | 143 | 96 | 48 | 240 | 192 |
| 144 | 144 | 97 | 49 | 1 | 193 |
| 145 | 145 | 98 | 50 | 2 | 194 |
| 191 | 191 | 144 | 96 | 43 | 240 |
| 192 | 192 | 145 | 97 | 44 | 1 |
| 193 | 193 | 146 | 98 | 45 | 2 |
| 239 | 239 | 192 | 144 | 96 | 48 |
| 240 | 240 | 193 | 145 | 97 | 49 |

Although an illustration was made in Table 1 for a case of a display device which has 240 scan lines and is fed gray level modulation signals of 4 pulses with the pulse interval of 48 scan lines, the scope of this invention is not limited to the above illustration.

The maximum numbers of scan lines and gray level modulation pulses may be limited only by driving conditions of the liquid crystal display being operated with the mentioned above two metastable states.

In addition, scan line numbers such as from 4 to 46, from 98 to 142, from 146 to 190 and from 94 to 238 in Table 1 are abbreviated for reasons of convenience without restricting the scope of the invention.

A further preferable embodiment of signal waveforms of the present invention is illustrated hereinbelow.

This illustration is made for a case of a display device which has 240 scan lines and is fed with gray level modulation signals having 5 pulses a frame period, as shown in Table 2.

TABLE 2

Scan Line, and Display and Gray Level Modulation Signals

| Scan line | Display | Gray level modulation signal | | | | |
|---|---|---|---|---|---|---|
| No. | signal | 1 | 2 | 3 | 4 | 5 |
| 1 | 1 | 1 | 194 | 146 | 98 | 50 |
| 2 | 2 | 2 | 195 | 147 | 99 | 51 |
| 3 | 3 | 3 | 196 | 148 | 100 | 52 |

TABLE 2-continued

Scan Line, and Display and Gray Level Modulation Signals

| Scan line | Display | Gray level modulation signal | | | | |
|---|---|---|---|---|---|---|
| No. | signal | 1 | 2 | 3 | 4 | 5 |
| 47 | 47 | 47 | 240 | 192 | 144 | 96 |
| 48 | 48 | 48 | 1 | 193 | 145 | 97 |
| 49 | 49 | 49 | 2 | 194 | 146 | 98 |
| 95 | 95 | 95 | 48 | 240 | 192 | 144 |
| 96 | 96 | 96 | 49 | 1 | 193 | 145 |
| 97 | 97 | 97 | 50 | 2 | 194 | 146 |
| 143 | 143 | 143 | 96 | 48 | 240 | 192 |
| 144 | 144 | 144 | 97 | 49 | 1 | 193 |
| 145 | 145 | 145 | 98 | 50 | 2 | 194 |
| 191 | 191 | 191 | 144 | 96 | 43 | 240 |
| 192 | 192 | 192 | 145 | 97 | 44 | 1 |
| 193 | 193 | 193 | 146 | 98 | 45 | 2 |
| 239 | 239 | 239 | 192 | 144 | 96 | 48 |
| 240 | 240 | 240 | 193 | 145 | 97 | 49 |

Although a gray level modulation signal is input to the identical pixel to which an on/off signal is input immediately before, the scope of this invention is not limited to the above illustration. For example, the gray level modulation signal 1 may preferably be hanged by the signal 2, and there may preferably be provided with a predetermined time interval between the on/off signal and the gray level modulation signal.

In the timing charts in the above illustrations, pulse waveforms having bipolarity are shown. However, the scope of this invention is not limited to these illustrations. For example, unipolar driving ICs as well as bipolar driving ICs may preferably be included in the units and a level shifting method such as, for example, a condenser coupling method, may also preferably be used in the present invention.

Furthermore, the scope of this invention is not limited by the viewpoint of the utilization of ac currents instead of dc currents, which may expectedly secure higher display characteristics. For example, display driving methods such as, for example, inverting the signal polarity (1) every other frame period (i.e., frame inversion) , and/or (2) every other or every certain number of scan lines (i.e., line inversion) may preferably be utilized within the scope of the present invention.

As to substrates 11, 12 of a liquid crystal display, the substrates 11, 12 may be composed of glass. In addition, the substrates 11, 12 may preferably be composed of plastics, thereby achieving lighter weight and thinner profile of the display device. Olefin plastics materials may preferably used as the substrate material.

The following examples are provided to further illustrate preferred embodiments of the invention.

EXAMPLE 1

A liquid crystal display device was fabricated including lower and upper transparent substrates 11,12, lower and upper delineated transparent electrodes 21, 22, lower and upper alignment films 31, 32, and a layer of nematic liquid crystal material 30.

The lower delineated transparent electrodes 21 were formed on an inner surface of the lower substrate 11, while the upper delineated transparent electrodes 22 were similarly formed on an inner surface of the upper substrate 12 in a direction orthogonal to the direction of the lower delineated transparent electrodes 21.

On surfaces of the transparent electrodes and exposed inner surfaces of the substrates, layers of polyimide (AL3046 from Japan Synthetic Rubber Co) were disposed and subsequently alignment treated by rubbing the surfaces of the polyimide layers in a uniform direction.

The lower and upper substrates 11, 12 thus prepared were subsequently arranged for respective rubbing directions on the alignment films 31, 32 to have an angle of 180° (or anti-parallel).

Prior to sealing these substrates, a liquid crystal material was prepared with a nematic liquid crystal ZLI-1557 from Merck &Co (refractive index anisotropy $\Delta n=0.1147$), mixed with a chiral nematic liquid crystal S-811 from Merck & Co which induced a right-handed helical structure, so as to have a predetermined pitch (p).

The liquid crystal material layer 30 was disposed between parallel lower and upper substrates 11, 12 such that the surface to surface separation (d) of the substrates was adjusted to 2.4 microns by selecting the diameter of silica beads placed in-between as spacers to result in a d/p ratio of 0.65. The liquid crystal material was then sealed between the substrates to constitute a liquid crystal display cell.

Subsequently, two polarizers 42, 41 were each disposed on the top and bottom faces of the cell substrate, and a liquid crystal display of the present invention was fabricated. At this point, the direction of transparency axis of one of the top and bottom polarizing plates was arranged to have a 45° angle between the alignment direction of an underlying alignment film, while the direction of transparency axis of the other polarizing plate was arranged to be symmetric with respect to the alignment direction.

Optical characteristics of the liquid crystal display device fabricated as above were measured by applying various voltage potentials to the display device, which will be described hereinbelow.

When a reset pulse having a width of 1 millisecond is applied, a threshold voltage of 18 volts was obtained between an initial state and metastable states. Also, when a second pulse having a width of 0.5 millisecond is applied subsequent to the reset pulse, it was found that (1) a threshold voltage of 2.5 volts was observed between the metastable states T and U, and (2) the T and U metastable states were obtained for the reset pulses of greater than and smaller than 2.5 volts, respectively. For the display device presently fabricated, a dark state and a bright state of the display resulted for the T and U metastable states, respectively.

Based on these measured values, the following voltage waveforms were selected for achieving the T and U metastable states. These waveforms are hereinafter referred to as T- and U-waveforms, respectively, as follows.

| | | |
|---|---|---|
| T-waveform | Reset pulse width ($W_R$): | 1 msec |
| | Reset pulse amplitude ($V_R$): | 25 volts |
| | 2nd pulse width ($W_{2nd}$): | 0.5 msec |
| | 2nd pulse amplitude ($V_{2nd}$): | 1 volt |
| | Frame frequency: | 50 Hz (20 msec/frame). |
| U-waveform | Reset pulse width ($W_R$): | 1 msec |
| | Reset pulse amplitude ($V_R$): | 25 volts |
| | 2nd pulse width ($W_{2nd}$): | 0.5 msec |
| | 2nd pulse amplitude ($V_{2nd}$): | 4 volts |
| | Frame frequency: | 50 Hz (20 msec/frame). |

Figure 2A:
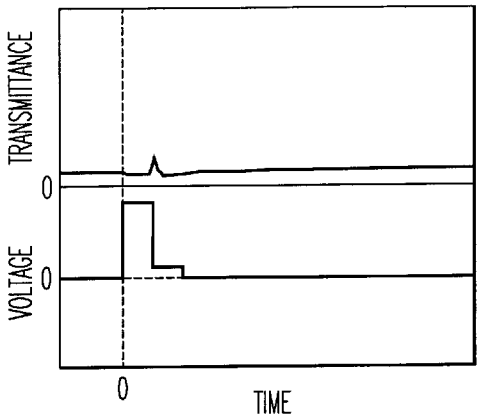
FIG. 2*a* is a graph of cell transmittance as a function of time comparing transmittance and pulse voltages, illustrating an application of a unipolar reset pulse and a succeeding unipolar second pulse having an amplitude smaller than a threshold voltage to result in a dark state.
Figure 2B:
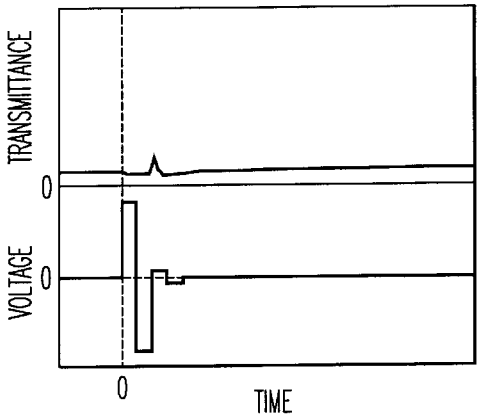
FIG. 2*b* is similar to FIG. 2*a* except that both the reset and second pulses are bipolar to result in a similar dark state.
Figure 2C:
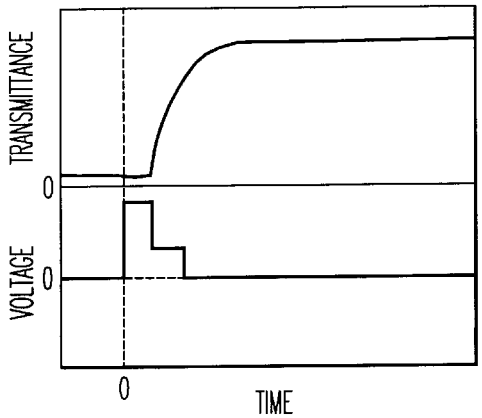
FIG. 2*c* is similar to FIG. 2*a* except that the succeeding unipolar second pulse has an amplitude larger than the threshold voltage to result in a bright state.
Figure 2D:
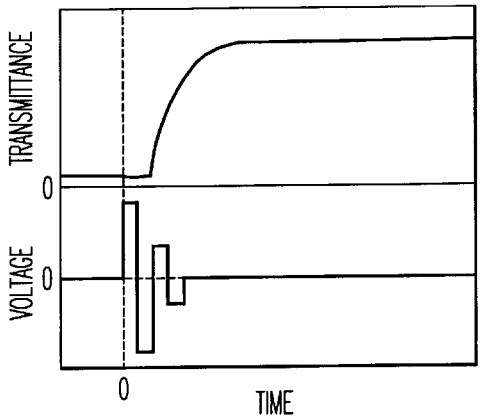
FIG. 2*d* is similar to FIG. 2*c* except that both the reset and second pulses are bipolar to result in a similar bright state.

Changes in transmittance of a liquid crystal display device with applied waveforms were preserved for the T- and U-waveforms as shown in FIGS. 2*a* and 2*c*, respectively. For the T- and U-waveforms, respectively, (1) frame averaged transmittances were obtained as 0.21% and 32.0%, (2) transmittance values were 0.21% and 35.6% when steady T- and U- metastable states are reached, and (3) 0.3 and 7.0 milliseconds were times required for these states to be reached after the application of the respective waveforms.

In addition, it was also found that when a constant 5 volt potential was applied to the display device starting a certain period of time after the application of a second pulse of the U-waveform, transmittance was decreased to 16.7% as shown in FIG. 3.

EXAMPLE 2

Optical characteristics of the liquid crystal display device of Example 1 were measured by applying various voltage potentials to the display device.

Following the application of a U-waveform potential, a sinusoidal voltage potential was applied starting a certain period of time after the application of a second pulse of the U-waveform, as shown in FIG. 4. Upon the application of the potential, a concomitant change in transmittance of the display cell was observed, as also shown in FIG. 4.

EXAMPLE 3

The liquid crystal display device of Example 1 was further provided with a quarter-wave plate 51 between one of the polarizers 42 and the neighboring substrate 12 with a retardation axis thereof orthogonal to the alignment direction of the polarizer 42.

When U-waveform and T-waveform potentials were applied to the display device, dark and bright states of the display device were obtained, respectively.

Also, when a constant 5 volt potential was applied to the display device starting 0.5 millisecond after the application of a second pulse of the T-waveform, the display device turned to a dark state due to the transition of the liquid crystal molecules to the U-metastable state by the applied potential. By contrast, when a constant 5 volt potential was applied starting 0.5 millisecond after the application of a second pulse of the U-waveform, transmittance of 16.7% was obtained similarly to the value obtained in Example 1.

EXAMPLE 4

Optical characteristics of the liquid crystal display device of Example 1 were measured by applying various voltage potentials to the display device.

Following the application of a U-waveform potential, a pulse voltage of 1 millisecond width and 5 volts amplitude was applied starting 10 milliseconds after the application of a second pulse of the U-waveform as shown in FIG. 7*a*.

Also, as shown in FIG. 7*a*, transmittance of the display cell decreased to about 17% upon the application of the pulse potential, and then returned to the original transmittance value upon the removal of the pulse potential.

In addition, during the application of the pulse potential, frame average transmittance was obtained as 26.9%. By contrast, frame average transmittance without the pulse application was 32.0% as obtained earlier in Example 1. Based on these observations, pulse potentials were applied onto every other frame of the display to examine whether any difference in transmittance is observed. As a result, it was found that differences in transmittance of display cells was visually recognized by the above pulse application.

EXAMPLE 5

Optical characteristics of the liquid crystal display device of Example 1 were measured by applying various voltage potentials to the display device.

Following the application of a U-waveform potential, a pulse voltage of 1 millisecond width and 5 volts amplitude was applied starting 0.5 millisecond after the application of a second pulse of the U-waveform as shown in FIG. 7*b*.

Also, as shown in FIG. 7*b*, transmittance of the display device was decreased to about 17% upon the application of the pulse potential, and then returned to the original transmittance value upon the removal of the pulse potential.

In addition, during the application of the pulse potential, frame average transmittance was obtained as 29.1%. By contrast, frame average transmittance without the pulse application was 32.0% as obtained earlier in Example 1. Based on these observations, pulse potentials were applied onto every other frame of the display to examine whether any difference in transmittance could be observed. As a result, it was found that differences in transmittance of display cells was visually recognized by the above pulse application.

EXAMPLE 6

Optical characteristics of the liquid crystal display cell were measured in a similar manner to Example 4, with the exception that the pulse amplitude of an applied pulse voltage was adjusted to 17 volts in place of 5 volts.

It was found that transmittance of the display device was decreased to about 1.5% upon the application of the pulse potential, and then returned to the original transmittance value upon the removal of the pulse potential.

In addition, when the pulse amplitude of an above applied pulse voltage was adjusted to 19 volts, a resetting in the liquid crystal layer occurred and display device was found to turn to a dark state.

EXAMPLE 7

Optical characteristics of the liquid crystal display device of Example 1 were measured by applying various voltage potentials to the display device.

Following the application of a U-waveform potential, pulse potentials of 5 volts amplitude were applied with a variety of pulse widths starting 4.5 milliseconds after the application of a second pulse of the U-waveform.

Results of the change in frame average transmittance with the applied pulse widths are shown in Table 3. In addition, when pulse potentials were applied with a reversed polarity onto every other frame of the display a difference in transmittance was visually recognized.

TABLE 3

| Gray level modulation pulse width (millisecond) | Frame average transmittance (%) |
|---|---|
| 0 | 32.0 |
| 2 | 29.2 |
| 4 | 21.4 |
| 8 | 14.2 |

EXAMPLE 8

Optical characteristics of the liquid crystal display device of Example 1 were measured by applying various voltage potentials to the display device.

Following the application of a U-waveform potential, pulse potentials of 4 millisecond width were applied with a variety of pulse amplitudes starting 4.5 milliseconds after the application of a second pulse of the U-waveform.

Result of the change in frame average transmittance with the applied pulse amplitudes are shown in Table 4. In addition, when pulse potentials were applied with a reversed polarity onto every other frame of the display, a difference in transmittance was visually recognized.

TABLE 4

| Gray level modulation pulse amplitude (volt) | Frame average transmittance (%) |
|---|---|
| 0 | 32.0 |
| 5 | 21.4 |
| 10 | 19.2 |
| 15 | 16.4 |

EXAMPLE 9

Optical characteristics of the liquid crystal display device of Example 1 were measured by applying various voltage potentials to the display device.

Following the application of a U-waveform potential, pulse potentials of 5 volts amplitude and 4 millisecond width were applied with varying the periods of time after the completion of the second pulse of the U-waveform.

Results of the change in frame average transmittance with the time periods are shown in Table 5. In addition, when pulse potentials were applied with a reversed polarity to every other frame of the display, a difference in transmittance was visually recognized.

TABLE 5

| Time after second pulse (msec) | Frame average transmittance (%) |
|---|---|
| 0 | 32.0 |
| 0.5 | 23.4 |
| 4.5 | 21.4 |
| 8.5 | 19.5 |

EXAMPLE 10

Optical characteristics of the liquid crystal display device of Example 1 were measured by applying various voltage potentials to the display device.

Following the application of a U-waveform potential, pulse potentials were applied with a variety of pulse widths and amplitudes 4.5 milliseconds after the application of a second pulse of the U-waveform.

Results of the change in frame average transmittance with the applied pulse widths and amplitudes are shown in Table 6. In addition, when pulse potentials were applied with a reversed polarity to every other frame of the display, a difference in transmittance was recognized.

TABLE 6

| Gray level modulation pulse width (msec) | Gray level modulation pulse amplitude (volt) | Frame average transmittance (%) |
|---|---|---|
| 0 | 0 | 32.0 |
| 2 | 5 | 29.1 |
| 2 | 10 | 26.5 |
| 2 | 10 | 24.0 |
| 4 | 5 | 21.4 |
| 4 | 10 | 19.2 |
| 4 | 15 | 16.4 |
| 8 | 5 | 14.2 |
| 8 | 10 | 11.5 |
| 8 | 15 | 9.0 |

EXAMPLE 11

Optical characteristics of the liquid crystal display device of Example 1 were measured by applying various voltage potentials to the display device.

Following the application of a U-waveform potential, pulse potentials of 5 volts amplitude were applied with changing pulse widths and the time periods after the application of a second pulse of the U-waveform.

Results of the change in frame average transmittance with the applied pulse widths and the time periods are shown in Table 7. In addition, when pulse potentials were applied with a reserved polarity on every other frame of the display, a difference in transmittance was visually recognized.

TABLE 7

| Gray level modulation pulse width (msec) | Time after second pulse (msec) | Frame average transmittance (%) |
|---|---|---|
| 0 | — | 32.0 |
| 2 | 0.5 | 31:4 |
| 2 | 4.5 | 29.1 |
| 2 | 8.5 | 26.9 |
| 4 | 0.5 | 23.4 |
| 4 | 4.5 | 21.4 |
| 4 | 8.5 | 19.5 |
| 8 | 0.5 | 16.3 |
| 8 | 4.5 | 14.2 |
| 8 | 8.5 | 12.0 |

EXAMPLE 12

Optical characteristics of the liquid crystal display device of Example 1 were measured by applying various voltage potentials to the display device.

Following the application of a U-waveform potential, pulse potentials of 4 millisecond width were applied with changing pulse amplitudes and time periods after the application of a second pulse of the U-waveform.

results of the change in frame average transmittance with the applied pulse amplitudes and the time periods are shown in Table 8. In addition, when pulse potentials were applied with a reversed polarity onto every other frame of the display, a difference in transmittance was visually recognized.

TABLE 8

| Gray level modulation pulse amplitude (volt) | Time after second pulse (msec) | Frame average transmittance (%) |
|---|---|---|
| 0 | — | 32.0 |
| 5 | 2.5 | 22.5 |
| 10 | 4.5 | 21.4 |
| 15 | 6.5 | 20.6 |
| 5 | 2.5 | 20.1 |
| 10 | 4.5 | 19.2 |
| 15 | 6.5 | 18.3 |
| 5 | 2.5 | 17.5 |
| 10 | 4.5 | 16.4 |
| 15 | 6.5 | 15.7 |

EXAMPLE 13

Optical characteristics of the liquid crystal display device of Example 1 were measured by applying various voltage potentials to the display device.

Following the application of a U-waveform potential, pulse potentials were applied with changing pulse amplitudes, widths and time periods after the application of a second pulse of the U-waveform.

Results of the change in frame average transmittance with the applied pulse widths, amplitudes and the periods of time are shown in Table 9. In addition, when pulse potentials were applied with a reversed polarity on every other frame of the display, a difference in transmittance was visually recognized.

TABLE 9

| Gray level modulation pulse width (msec) | Gray level modulation pulse amplitude (volt) | Time after second pulse (msec) | Frame average transmittance (%) |
|---|---|---|---|
| 0 | 0 | — | 32.0 |
| 2 | 5 | 2.5 | 30.5 |
| 2 | 5 | 4.5 | 29.1 |
| 2 | 5 | 6.5 | 27.9 |
| 2 | 10 | 2.5 | 27.2 |
| 2 | 10 | 4,5 | 26.5 |
| 2 | 10 | 6.5 | 25.6 |
| 2 | 15 | 2.5 | 25.6 |
| 2 | 15 | 4.5 | 25.1 |
| 2 | 15 | 6.5 | 24.0 |
| 4 | 5 | 2.5 | 22.9 |
| 4 | 5 | 4.5 | 22.5 |
| 4 | 5 | 6.5 | 21.4 |
| 4 | 10 | 2.5 | 20.6 |
| 4 | 10 | 4.5 | 19.2 |
| 4 | 10 | 6.5 | 18.3 |
| 4 | 15 | 2.5 | 17.5 |
| 4 | 15 | 4.5 | 16.4 |
| 4 | 15 | 6.5 | 15.7 |
| 8 | 5 | 2.5 | 15.1 |
| 8 | 5 | 4.5 | 14.2 |
| 8 | 5 | 6.5 | 13.0 |
| 8 | 10 | 2.5 | 12.4 |
| 8 | 10 | 4.5 | 11.5 |
| 8 | 10 | 6.5 | 10.3 |
| 8 | 15 | 2.5 | 9.9 |
| 8 | 15 | 4.5 | 9.0 |
| 8 | 15 | 6.5 | 7.9 |

EXAMPLE 14

A liquid crystal display system was constructed, including a liquid crystal material having two metastable states for the liquid crystal display and a display drive unit of FIG. 13 using a drive controller isp-LSI 1032 (C-PLD from Lattice Co). The liquid crystal display was composed of 320×80 display pixels.

Gray level modulation signals were composed such that two pulses were applied to selected scan lines. The selection of scan lines with respect to the gray level modulation signal are carried out as shown in Table 10. A numeral in the second through fourth column in Table 10 denotes the number of the scan line to which each of the signals is input.

TABLE 10

| Gray Level Modulation Signals and Scan Line | | | |
|---|---|---|---|
| Scan line No. | Display signal | Gray level modulation signal 1 | Gray level modulation signal 2 |
| 1 | 1 | 55 | 28 |
| 2 | 2 | 56 | 29 |
| 3 | 3 | 57 | 30 |
| 26 | 26 | 80 | 53 |
| 27 | 27 | 1 | 54 |
| 28 | 28 | 2 | 55 |
| 53 | 53 | 27 | 80 |
| 54 | 54 | 28 | 1 |
| 55 | 55 | 29 | 2 |
| 80 | 80 | 54 | 27 |

Results in Table 10 indicate that a gray level modulation of the display device is feasible with a four-step gray scale. It should be noted that for the display device of the present invention under the present driving conditions in particular, the maximum transmittance or reflectivity value obtained during a gray scale operation of the display is comparable to these values inherent in the display without any decrease in transmittance or reflectivity of the present display device caused by the gray level modulation.

EXAMPLE 15

A liquid crystal display system was constructed in a similar manner to Example 14, with the exception that six pulses were applied to selected scan lines in place of two in the previous Example. These pulses were input to each of six scan lines as shown in Table 11.

A numeral in the second through fourth column in Table 11 denotes the number of the scan line to which each signal is input.

TABLE 11

Gray Level Modulation Signals, Scan Lines and Data Lines

| Scan line | Data line | Gray level modulation signal | | | | | |
|---|---|---|---|---|---|---|---|
| No. | No. | 1 | 2 | 3 | 4 | 5 | 6 |
| 1 | 1 | 208 | 174 | 140 | 106 | 72 | 38 |
| 2 | 2 | 209 | 175 | 141 | 107 | 73 | 39 |
| 3 | 3 | 210 | 176 | 142 | 108 | 74 | 40 |
| 33 | 33 | 240 | 206 | 172 | 138 | 104 | 70 |
| 34 | 34 | 1 | 207 | 173 | 139 | 105 | 71 |
| 35 | 35 | 2 | 208 | 174 | 140 | 106 | 72 |
| 67 | 67 | 34 | 240 | 206 | 172 | 138 | 104 |
| 68 | 68 | 35 | 1 | 207 | 173 | 139 | 105 |
| 69 | 69 | 36 | 2 | 208 | 174 | 140 | 106 |
| 104 | 101 | 68 | 34 | 240 | 206 | 172 | 138 |
| 102 | 102 | 69 | 35 | 1 | 207 | 173 | 139 |
| 103 | 103 | 70 | 36 | 2 | 208 | 174 | 140 |
| 135 | 135 | 102 | 68 | 34 | 240 | 206 | 172 |
| 136 | 136 | 103 | 69 | 35 | 1 | 207 | 173 |
| 137 | 137 | 104 | 70 | 36 | 2 | 208 | 174 |
| 169 | 169 | 136 | 102 | 68 | 34 | 240 | 206 |
| 170 | 170 | 137 | 103 | 69 | 35 | 1 | 207 |
| 171 | 171 | 138 | 104 | 70 | 36 | 2 | 208 |
| 203 | 203 | 170 | 136 | 102 | 68 | 34 | 240 |
| 204 | 204 | 171 | 137 | 103 | 69 | 35 | 1 |
| 205 | 205 | 172 | 138 | 104 | 70 | 36 | 2 |
| 239 | 239 | 206 | 172 | 138 | 104 | 70 | 36 |
| 240 | 240 | 207 | 173 | 139 | 105 | 71 | 37 |

Results in Table 11 indicate that a gray level modulation of the display device is feasible with an eight-step gray scale. It should be noted that for the display device of the present invention under the present drive conditions, the maximum transmittance or reflectivity value obtained during a gray scale operation of the display is comparable to these values inherent in the display without any decrease in transmittance or reflectivity of the present display device caused by the gray level modulation.

EXAMPLE 16

A liquid crystal display system was constructed in a similar manner to Example 14 and gray level modulation signals were input to each scan line as shown in Table 2.

A numeral in the second through fourth column in Table 2 denotes the number of the scan line to which each signal is input.

Results from driving the display device indicate that a gray level modulation of the display device is feasible with a seven-step gray scale. It is also indicated from the results that the maximum transmittance or reflectivity value obtained during a gray scale operation of the display is comparable to these values inherent in the display without any decrease in transmittance or reflectivity caused by the gray level modulation.

EXAMPLE 17

A liquid crystal display system was constructed in a similar manner to Example 14, with the exception that a pair of thin polyether sulphone plates were used as the substrates for the liquid crystal display. In addition, a liquid crystal display with a pair of glass substrates was also fabricated for comparison.

For the system with the display having the polyether sulphone substrates, results from driving the display indicate that a gray level modulation of the display device is feasible with a four-step gray scale. It is also found that the display device is lighter in weight than that fabricated with the glass substrates, and that images displayed on the system are quite clear without suffering from double images, particularly when driven in a reflection mode.

EXAMPLE 18

A liquid crystal display system was constructed in a similar manner to Example 14, with the exception that an electrically alterable controller is composed of EEPROMs to thereby externally input the scan sequence of display lines. With this construction, two gray level modulation signals were input to selected scan lines.

Results from driving the display device indicate that the change in gray levels was visually recognized by altering the modulation sequence of line scanning. It is indicated from the results that it is feasible to externally alter the scan sequence of display lines.

EXAMPLE 19

A liquid crystal display system was constructed in a similar manner to Example 14 and two gray level modulation signals were input to selected scan lines.

Input patterns for gray level modulation signals were stored in a controller shown in Table 3 and a block diagram of a control circuit including the controller is shown in FIG. 13.

The display device was driven by sequentially generating the following two driving signals every other frame period: (1) on/off display signals generated by the aforementioned display data composition circuit shown in FIG. 11, and (2) gray level modulation signals composed in a similar manner to Example 14.

Results from driving the display device indicate that a gray level modulation of the display device is feasible with a four-step gray scale. It is also indicated from the results that the maximum transmittance or reflectivity value obtained during the display driving is comparable to these values inherent in the display without any decrease in transmittance or reflectivity caused by the gray level modulation.

As described hereinbefore, the liquid crystal display device of the present invention is capable of providing gray scale displays by arbitrarily modulating at least one of two metastable states of the liquid crystal material. This is an improvement over background bistable twisted-nematic type display devices in which display drive has been carried out by selecting only one of two metastable states at a time to thereby result in only binary gray scale displays.

Also, by correlating the U-metastable state to the bright display state in the display device, it becomes feasible for succeeding gray level modulation voltage potentials to be applied more immediately after the second pulse and to thereby become more flexible in the application of modulation voltage potentials. In addition, it is more advantageous for this construction not to have an additional phase plate, thereby leading to a simpler construction of the display device.

In addition, a variety of drive conditions to achieve the gray level modulation can be employed in the present display device. Namely, although modulation pulses various in each of widths, amplitudes, and time periods from second pulses are respectively employed, the combination of at least two of these three variables may also be effectively employed in the modulation pulse application in the display drive.

Furthermore, in the display drive in the present invention, the maximum transmittance or reflectivity value is achieved by the gray level modulation without causing any decrease in transmittance or reflectivity of the present display device.

The present invention thus provides a liquid crystal display device and its drive methods capable of a high speed switching between bright and dark states with arbitrary gray level modulation steps. Therefore, the present display device may preferably be employed not only as liquid crystal display cells but also a variety of other applications such as, for example, light shutters and light valves for which the high speed switching and gray scale characteristics are highly desirable.

Obviously, numerous modifications and variations of the present invention are possible in light of the above teachings. It is therefore to be understood that within the scope of the appended claims, the invention may be practiced otherwise than as specifically described herein.

The present application is based on Japanese priority documents 9-038373, 9-273548 and 9-356122, the contents of which are incorporated herein by reference.

What is claimed as new and desired to be secured by Letters Patent of the United States is:

1. A liquid crystal display device, comprising:

a first transparent substrate;

a second transparent substrate arranged substantially parallel to said first transparent substrate;

a first group of delineated transparent electrodes formed substantially parallel to each other on a major surface of said first transparent substrate;

a second group of delineated transparent electrodes formed substantially parallel to each other on a major surface of said second transparent substrate and arranged substantially orthogonal to said first group of delineated transparent electrodes;

alignment films disposed over each of said first and second groups of delineated transparent electrodes, a surface of each of said alignment films being alignment treated;

polarizing plates disposed relative to each of second major surfaces of said first and second groups of delineated transparent electrodes; and a layer of a chiral nematic liquid crystal material having a positive dielectric anisotropy constant, said layer of chiral nematic liquid crystal material being sealed and gradually twisted in a predetermined manner between said first and second transparent substrates, wherein electrodes of said first group of delineated transparent electrodes, and one of electrodes of said second group of delineated transparent electrodes with said layer of said liquid crystal material disposed in between from a display cell, and said layer of liquid crystal material being in and switched between first and second metastable states caused by relaxation from a state previously formed by a Freedricksz transition, and electrodes of said first and second groups of delineated transparent electrodes are used as signal electrodes and scan electrodes, respectively; and means for applying, between at least one of said signal electrodes and at least one of said scan electrodes, a reset pulse voltage to induce the Freedricksz transition of said liquid crystal layer and a second pulse voltage to select one of said first and second metastable states of said liquid crystal material based on an amplitude of said second pulse voltage.

2. The liquid crystal display device in accordance with claim 1, wherein a twist angle of said liquid crystal material in said display cell along a thickness direction is $\phi+180°$ for the first metastable state and $\phi-180°$ for the second metastable state, wherein the angle $\phi$ is a twist angle for an initial state of said liquid crystal material.

3. A liquid crystal display device comprising:

a first transparent substrate;

a second transparent substrate arranged substantially parallel to said first transparent substrate;

a first group of delineated transparent electrodes formed substantially parallel to each other on a major surface of said first transparent substrate;

a second group of delineated transparent electrodes formed substantially parallel to each other on a major surface of said second transparent substrate and arranged substantially orthogonal to said first group of delineated transparent electrodes;

alignment films disposed over each of said first and second groups of delineated transparent electrodes, a surface of each of said alignment films being alignment treated;

polarizing plates disposed relative to each of second major surfaces of said first and second groups of delineated transparent electrodes; and a layer of a chiral nematic liquid crystal material having a positive dielectric anisotropy constant, said layer of chiral nematic liquid crystal material being sealed and gradually twisted in a predetermined manner between said first and second transparent substrates, wherein electrodes of said first group of delineated transparent electrodes, and one of electrodes of said second group of delineated transparent electrodes with said layer of said liquid crystal material disposed in between from a display cell, and said layer of liquid crystal material being in and switched between first and second metastable states caused by relaxation from a state previously formed by a Freedricksz transition, and electrodes of said first and second groups of delineated transparent electrodes are used as signal electrodes and scan electrodes, respectively, wherein said alignment films are disposed with a parallel alignment direction, pre-tilt angles formed on respective alignment film surfaces by a molecular axis of said liquid crystal material at an initial state are substantially equal to each other, and a ratio of an intrinsic helical pitch to a thickness of said liquid crystal material is from 1 to 2.2.

4. The liquid crystal display device in accordance with claim 3, wherein said pre-tilt angles are from 2° to 30°.

5. The liquid crystal display device in accordance with claim 2, wherein said twist angle $\phi$ is equal to approximately 180°.

6. A liquid crystal display device comprising:

a first transparent substrate;

a second transparent substrate arranged substantially parallel to said first transparent substrate;

a first group of delineated transparent electrodes formed substantially parallel to each other on a major surface of said first transparent substrate;

a second group of delineated transparent electrodes formed substantially parallel to each other on a major surface of said second transparent substrate and arranged substantially orthogonal to said first group of delineated transparent electrodes;

alignment films disposed over each of said first and second groups of delineated transparent electrodes, a surface of each of said alignment films being alignment treated;

polarizing plates disposed relative to each of second major surfaces of said first and second groups of delineated transparent electrodes; and a layer of a chiral nematic liquid crystal material having a positive dielectric anisotropy constant, said layer of chiral nematic liquid crystal material being sealed and gradually twisted in a predetermined manner between said first and second transparent substrates, wherein electrodes of said first group of delineated transparent electrodes, and one of electrodes of said second group of delineated transparent electrodes with said layer of said liquid crystal material disposed in between from a display cell, and said layer of liquid crystal material being in and switched between first and second metastable states caused by relaxation from a state previously formed by a Freedricksz transition, and electrodes of said first and second groups of delineated transparent electrodes are used as signal electrodes and scan electrodes, respectively.

wherein said transparent substrates are comprised of plastics.

7. A liquid crystal display device comprising:

a first transparent substrate;

a second transparent substrate arranged substantially parallel to said first transparent substrate;

a first group of delineated transparent electrodes formed substantially parallel to each other on a major surface of said first transparent substrate;

a second group of delineated transparent electrodes formed substantially parallel to each other on a major surface of said second transparent substrate and arranged substantially orthogonal to said first group of delineated transparent electrodes;

alignment films disposed over each of said first and second groups of delineated transparent electrodes, a surface of each of said alignment films being alignment treated;

polarizing plates disposed relative to each of second major surfaces of said first and second groups of delineated transparent electrodes; and a layer of a chiral nematic liquid crystal material having a positive dielectric anisotropy constant, said layer of chiral nematic liquid crystal material being sealed and gradually twisted in a predetermined manner between said first and second transparent substrates, wherein electrodes of said first group of delineated transparent electrodes, and one of electrodes of said second group of delineated transparent electrodes with said layer of said liquid crystal material disposed in between from a display cell, and said layer of liquid crystal material being in and switched between first and second metastable states caused by relaxation from a state previously formed by a Freedricksz transition, and electrodes of said first and second groups of delineated transparent electrodes are used as signal electrodes and scan electrodes, respectively, means for applying first, second and at least one third voltage potentials between at least one of said signal electrodes and at least one of said scan electrodes; said first voltage potential being used to initiate the Freedricksz transition of said layer of said liquid crystal material, said second voltage potential being used to select one of said first and second metastable states of said liquid crystal material, and said at least one third voltage potential being used as modulation voltage potential to switch between said first and second metastable states, wherein said first voltage potential is higher than a threshold voltage necessary to induce a transition from an initial state to said metastable states, said second voltage potential is applied in comparison with a voltage necessary to switch between said first and second metastable states, and said third voltage potential is applied during or following application of said second potential and is smaller than the threshold voltage, thereby modulating at least one liquid crystal cell on one of said second group of delineated transparent electrodes which is presently selected, and other electrodes of said second group of delineated transparent electrodes which are not presently selected.

8. The liquid crystal display device in accordance with claim 7, wherein transmittance of an individual cell of said liquid crystal display device is modulated without switching from said first metastable state to said second metastable state.

9. The liquid crystal display device in accordance with claim 8, wherein at least one of said first, second and third voltage potentials is applied in a pulse waveform.

10. The liquid crystal display device in accordance with claim 8, wherein said third voltage potential is applied in a pulse waveform, having a pulse width arbitrarily obtained as a combination of a variety of predetermined pulse widths.

11. The liquid crystal display device in accordance with claim 8, wherein said third voltage potential is applied in a pulse waveform, having a pulse amplitude arbitrarily obtained as a combination of a variety of predetermined pulse amplitudes.

12. The liquid crystal display device in accordance with claim 8, wherein said third voltage potential is applied in a pulse waveform, after a certain time period which is arbitrarily obtained as a combination of a variety of predetermined time periods.

13. The liquid crystal display device in accordance with claim 7, wherein said first metastable state has a higher transmittance than said second metastable state and wherein said third voltage potential is applied to said first metastable state.

14. The liquid crystal display device in accordance with claim 13, wherein at least one of said first, second or third voltage potentials is applied in a pulse waveform.

15. The liquid crystal display device in accordance with claim 14, wherein one of said modulation voltage potential is applied in a pulse waveform, having a pulse width arbitrarily obtained as a combination of a variety of predetermined pulse widths.

16. The liquid crystal display device in accordance with claim 14, wherein one of said modulation voltage potentials is applied in a pulse waveform, having a pulse amplitude arbitrarily obtained as a combination of a variety of predetermined pulse amplitudes.

17. The liquid crystal display device in accordance with claim 14, wherein one of said modulation voltage potentials is applied in a pulse waveform after a certain time period arbitrarily obtained as a combination of a variety of predetermined time periods.

18. The liquid crystal display device in accordance with claim 7, further comprising:

means for applying at least one of on- and off-data voltage potentials together with said first and second voltage potentials, to at least one selected of said scan electrodes; and means for applying one of said modulation voltage potentials to at least one of said signal electrodes, wherein a display cell of said liquid crystal display device on the selected scan electrode and at least one display cell on non-selected scan electrode are modulated by at least one of said first, second or third voltage potentials to thereby modulate transmittance of said display cell.

19. The liquid crystal display device in accordance with claim 18, wherein said display cell of said liquid crystal display device on said selected scan electrode and at least one of said display cell on said non-selected scan electrodes are addressed sequentially.

20. The liquid crystal display device in accordance with claim 18, wherein transmittance of each display cell of said liquid crystal display device is modulated by a voltage potential waveform which is a composite of voltage potential waveforms input from both said signal electrodes and said scan electrodes.

21. The liquid crystal display device in accordance with claim 20, wherein voltage potentials applied to at least one of said signal electrodes are on- or off-data voltage potentials, and said modulation voltage potentials are applied to said display cell on said selected electrode and at least one of display cell on said non-selected electrodes.

22. The liquid crystal display device in accordance with claim 20, wherein each of said scan electrodes is arbitrarily selected by display drive signals.

23. The liquid crystal display device in accordance with claim 20, wherein each of said scan electrodes is arbitrarily selected by display drive signals stored in external alterable memories.

24. The liquid crystal display device in accordance with claim 20, wherein at least one of said voltage potentials applied to one of said scan electrodes is one of a validating signal which validates said on- or off-data signals and at least one of said modulation voltage potentials, input to each of said display cells on a presently selected scan line, an invalidating signal which invalidates said on- or off-data signals and at least one of said modulation voltage potentials, input to each of said display cells on a presently non-selected scan line.

25. The liquid crystal display device in accordance with claim 20, wherein validating and invalidating one of said modulation voltage potentials is carried out by phase differences between voltage potential waveforms input from said signal electrodes and scan electrodes.

26. The liquid crystal display device in accordance with claim 20, wherein an interval of scan lines for inputting a validating modulation signal is determined by a number of said scan electrodes and said modulation signals.

27. The liquid crystal display device in accordance with claim 7, wherein transmittance of each of said display cells is displayed succeeding an average over a plurality of frames of said liquid crystal display.

28. A liquid crystal display device, comprising:

a first transparent substrate;

a second transparent substrate arranged substantially parallel to said first transparent substrate;

a first group of delineated transparent electrodes formed substantially parallel to each other on a major surface of said first transparent substrate;

a second group of delineated transparent electrodes formed substantially parallel to each other on a major surface of said second transparent substrate and arranged substantially orthogonal to said first group of delineated transparent electrodes, said first and second groups of delineated transparent electrodes being used as signal electrodes and scan electrodes, respectively;

alignment films disposed over each of said first and second groups of delineated transparent electrodes, a surface of each of said alignment films being alignment treated;

polarizing plates disposed relative to each of second major surfaces of said first and second groups of delineated transparent electrodes;

a layer of a chiral nematic liquid crystal material having a positive dielectric anisotropy constant, said layer of chiral nematic liquid crystal material being sealed and gradually twisted in a predetermined manner between said first and second transparent substrates, said layer of a chiral nematic liquid crystal material being in and switched between first and second metastable states which are caused by relaxation from a state previously formed by a Freedricksz transition; and means for applying first, second and at least one third voltage potentials between at least one of said signal electrodes and at least one of said scan electrodes; said first voltage potential being used to initiate the Freedricksz transition of said layer of said liquid crystal material, said second voltage potential being used to select one of said first and second metastable states of said liquid crystal material, and said at least one third voltage potential being used as modulation voltage potentials to switch between said first and second metastable states, wherein said first voltage potential is higher than a threshold voltages necessary to induce a transition from an initial state to said first and second metastable states, said second voltage potential is applied in comparison with a voltage necessary to switch between said first and second metastable states, and said at least one third voltage potential is applied during or following application of said second potential and is smaller than the threshold voltage, thereby modulating at least one liquid crystal cell on one of said second group of delineated transparent electrodes which is presently selected and other electrodes of said second group of delineated transparent electrodes which are not presently selected.

29. The liquid crystal display device in accordance with claim 28, wherein a twist angle of said liquid crystal material in said display cell along a thickness direction is $\phi+180°$ for the first metastable state, and is $\phi-180°$ for the second metastable state, the angle $\phi$ being a twist angle for an initial state of said liquid crystal material;

wherein said alignment films are disposed with a parallel alignment direction, pre-tilt angles being formed on respective alignment film surfaces by a molecular axis of said liquid crystal material at an initial state are substantially equal to each other; a ratio of an intrinsic helical pitch to a thickness of said nematic liquid crystal material is from 1 to 2.2; said pre-tilt angles is from 2° to 30°; said twist angle $\phi$ is equal to approximately 180°; and said transparent substrates are comprised of plastics.

30. The liquid crystal display device in accordance with claim 28, wherein transmittance of an individual cell of said liquid crystal display device is modulated without switching from said first metastable state to said second metastable state.

31. The liquid crystal display device in accordance with claim 30, wherein at least one of said first, second and third voltage potentials is applied in a pulse waveform.

32. The liquid crystal display device in accordance with claim 31, wherein said third voltage potential is applied in a pulse waveform, having a pulse width arbitrarily obtained as a combination of a variety of predetermined pulse widths.

33. The liquid crystal display device in accordance with claim 31, wherein said third voltage potential is applied in a pulse waveform, having a pulse amplitude arbitrarily obtained as a combination of a variety of predetermined pulse amplitudes.

34. The liquid crystal display device in accordance with claim 31, wherein said third voltage potential is applied in a pulse waveform, after a certain time period arbitrarily obtained as a combination of a variety of predetermined time periods.

35. The liquid crystal display device in accordance with claim 28, wherein said first metastable state has a higher transmittance than said second metastable state and wherein said at least one third voltage potential is applied to said first metastable state.

36. The liquid crystal display device in accordance with claim 35, wherein at least one of said first, second or third voltage potentials is applied in a pulse waveform.

37. The liquid crystal display device in accordance with claim 36, wherein one of said modulation voltage potentials is applied in a pulse waveform, having a pulse width arbitrarily obtained as a combination of a variety of predetermined pulse widths.

38. The liquid crystal display device in accordance with claim 36, wherein one of said modulation voltage potentials is applied in a pulse waveform, having a pulse amplitude arbitrarily obtained as a combination of a variety of predetermined pulse amplitudes.

39. The liquid crystal display device in accordance with claim 36, wherein one of said modulation voltage potentials is applied in a pulse waveform after a certain time period arbitrarily obtained as a combination of a variety of predetermined time periods.

40. The liquid crystal display device in accordance with claim 28, further comprising:

means for applying at least one of on- and off-data voltage potentials together with said first and second voltage potentials, to at least one selected of said scan electrodes; and means for applying one of said modulation voltage potentials to at least one of said signal electrodes, wherein a display cell of said liquid crystal display device on a selected scan electrode and at least one display cell on non-selected scan electrodes are modulated by at least one of said first, second or third voltage potentials to thereby modulate transmittance of said display cell.

41. The liquid crystal display device in accordance with claim 40, wherein said display cell of said liquid crystal display device on said selected scan electrode and at least one of said display cell on said non-selected scan electrodes are addressed sequentially.

42. The liquid crystal display device in accordance with claim 41, wherein transmittance of each display cell of said liquid crystal display device is modulated by a voltage potential waveform which is a composite of voltage potential waveforms input from both said signal electrodes and said scan electrodes.

43. The liquid crystal display device in accordance with claim 42, wherein voltage potentials applied to at least one of said signal electrodes are on- or off-data voltage potentials, and said modulation voltage potentials are applied to said display cell on said selected electrode and at least one of display cell on said non-selected electrodes.

44. The liquid crystal display device in accordance with claim 42, wherein each of said scan electrodes is arbitrarily selected by display drive signals.

45. The liquid crystal display device in accordance with claim 42, wherein each of said scan electrodes is arbitrarily selected by display drive signals stored in external alterable memories.

46. The liquid crystal display device in accordance with claim 42, wherein at least one of said voltage potentials applied to one of said scan electrodes is a validating signal which validates said on- or off-data signals and at least one of said modulation voltage potentials, input to each of said display cells on a presently selected scan line, an invalidating signal which invalidates said on- or off-data signals and at least one of said modulation voltage potentials, input to each of said display cells on a presently non-selected scan line.

47. The liquid crystal display device in accordance with claim 42, wherein validating and invalidating one of said modulation voltage potentials is carried out by phase differences between voltage potential waveforms input from said signal electrodes and scan electrodes.

48. The liquid crystal display device in accordance with claim 42, wherein an interval of scan lines for inputting a validating modulation signal is determined by a number of said scan electrodes and said modulation signals.

49. The liquid crystal display device in accordance with claim 28, wherein transmittance of each of said display cell is displayed succeeding an average over a plurality of frames of said liquid crystal display.

50. A method of providing a liquid crystal display device, comprising:

forming a first transparent substrate;

forming a second transparent substrate arranged substantially parallel to said first transparent substrate;

forming a first group of delineated transparent electrodes formed substantially parallel to each other on a major surface of said first transparent substrate;

forming a second group of delineated transparent electrodes formed substantially parallel to each other on a major surface of said second transparent substrate and arranged substantially orthogonal to said first group of delineated transparent electrodes, said first and second groups of delineated transparent electrodes being used as signal electrodes and scan electrodes, respectively;

forming alignment films disposed over each of said first and second groups of delineated transparent electrodes, a surface of each of said alignment films being alignment treated;

forming polarizing plates disposed relative to each of second major surfaces of said first and second groups of delineated transparent electrodes;

forming a layer of a chiral nematic liquid crystal material having a positive dielectric anisotropy constant, said layer of chiral nematic liquid crystal material being sealed and gradually twisted in a predetermined manner between said first and second transparent substrates, said layer of a chiral nematic liquid crystal material being in and switched between first and second metastable states caused by relaxation from a state previously formed by a Freedricksz transition; and applying first, second and at least one third voltage potentials between at least one of said signal electrodes and at least one of said scan electrodes; said first voltage potential being used to initiate the Freedricksz transition of said layer of said liquid crystal material, said second voltage potential being used to select one of said first and second metastable states of said liquid crystal material, and said at least one third voltage potential being used as modulation voltage potentials to switch between said first and second metastable states, wherein said first voltage potential is higher than a threshold voltage necessary to induce a transition from an initial state to said first and second metastable states, said second voltage potential is applied in comparison with a voltage necessary to switch between said first and second metastable states, and said at least one third voltage potential is applied during or following application of said second potential and is smaller than the threshold voltage, thereby modulating at least one of said liquid crystal cell on one of said second group of delineated transparent electrodes which is presently selected, and other electrodes of said second group of delineated transparent electrodes which are not presently selected.

51. The method in accordance with claim 50, wherein a twist angle of said liquid crystal material in said display cell along a thickness direction of the cell is $\phi+180°$ for the first metastable state, and is $\phi-180°$ for the second metastable state, the angle $\phi$ being a twist angle for an initial state of said liquid crystal material;

wherein said alignment films are disposed with a parallel alignment direction, pre-tilt angles are formed on respective alignment film surfaces by a molecular axis of said liquid crystal material at an initial state substantially equal to each other; a ratio of an intrinsic helical pitch to a layer thickness of said nematic liquid crystal material is from 1 to 2.2; said pre-tilt angles is from 2° to 30°; said twist angle $\phi$ is equal to approximately 180°; and said transparent substrates are comprised of plastics.

52. The method in accordance with claim 50, wherein transmittance of an individual cell of said liquid crystal display device is modulated without switching from said first metastable state to said second metastable state.

53. The method in accordance with claim 52, wherein at least one of said first, second and third voltage potentials is applied in a pulse waveform.

54. The method in accordance with claim 53, wherein said third voltage potential is applied in a pulse waveform, having a pulse width arbitrarily obtained as a combination of a variety of predetermined pulse widths.

55. The method in accordance with claim 53, wherein said third voltage potential is applied in a pulse waveform, having a pulse amplitude arbitrarily obtained as a combination of a variety of predetermined pulse amplitudes.

56. The method in accordance with claim 53, wherein said third voltage potential is applied in a pulse waveform, after a certain time period arbitrarily obtained as a combination of a variety of predetermined time periods.

57. The method in accordance with claim 50, wherein said first metastable state has a higher transmittance than said second metastable state and wherein said at least one third voltage potential is applied to said first metastable state.

58. The method in accordance with claim 57, wherein at least one of said first, second and third voltage potentials is applied in a pulse waveform.

59. The method in accordance with claim 58, wherein one of said modulation voltage potentials is applied in a pulse waveform, having a pulse width arbitrarily obtained as a combination of a variety of predetermined pulse widths.

60. The method in accordance with claim 58, wherein one of said modulation voltage potentials is applied in a pulse waveform, having a pulse amplitude arbitrarily obtained as a combination of a variety of predetermined pulse amplitudes.

61. The method in accordance with claim 58, wherein one of said modulation voltage potentials is applied in a pulse waveform after a certain time period arbitrarily obtained as a combination of a variety of predetermined time periods.

62. The method in accordance with claim 50, further comprising:

applying at least one of on- and off -data voltage potentials together with said first and second voltage potentials, to at least one selected of said scan electrodes; and applying one of said modulation voltage potentials to at least one of said signal electrodes, wherein a display cell of said liquid crystal display device on a selected scan electrode and at least one display cell on non-selected scan electrodes are modulated by at least one of said first, second or third voltage potentials to thereby modulate transmittance of said display cell.

63. The method in accordance with claim 62, wherein said display cell of said liquid crystal display device on said selected scan electrode and at least one of said display cell on said non-selected scan electrodes are addressed sequentially.

64. The method in accordance with claim 62, wherein transmittance of each display cell of said liquid crystal display device is modulated by a voltage potential waveform which is a composite of voltage potential waveforms input from both said signal electrodes and said scan electrodes.

65. The method in accordance with claim 64, wherein voltage potentials applied to at least one of said signal electrodes are on- or off -data voltage potentials, and said modulation voltage potentials applied to said display cell on said selected electrode and at least one of display cell on said non-selected electrodes.

66. The method in accordance with claim 64, wherein each of said scan electrodes is arbitrarily selected by display drive signals.

67. The method in accordance with claim 64, wherein each of said scan electrodes is arbitrarily selected by display drive signals stored in external alterable memories.

68. The method in accordance with claim 64, wherein at least one of said voltage potentials applied to one of said scan electrodes is one of a validating signal which validates signals said on- or off-data signals and at least one of said modulation voltage potentials, input to each of said display cells on a presently selected scan line, and an invalidating signal which invalidates said on- or off-data signals and at least one of said modulation voltage potentials, input to each of said display cells on a presently nonselected scan line.

69. The method in accordance with claim 64, wherein validating and invalidating one of said modulation voltage potentials is carried out by phase differences between voltage potential waveforms input from said signal electrodes and scan electrodes.

70. The method in accordance with claim 64, wherein an the interval of scan lines for inputting a validating modulation signal is determined by a number of said scan electrodes and said modulation signals.

71. The method in accordance with claim 50, wherein transmittance of each of said display cells is displayed succeeding an average over a plurality of frames of said liquid crystal display.

* * * * *